US006826880B2

(12) United States Patent
Yost et al.

(10) Patent No.: US 6,826,880 B2
(45) Date of Patent: Dec. 7, 2004

(54) CORNER ASSEMBLIES FOR CONCRETE FORM PANELS

(76) Inventors: Louis L. Yost, 16365 Falls Rd., Monkton, MD (US) 21111; William R. Yost, 16365 Falls Rd., Monkton, MD (US) 21111

( * ) Notice: Subject to any disclaimer, the term of this patent is extended or adjusted under 35 U.S.C. 154(b) by 0 days.

(21) Appl. No.: 10/369,078

(22) Filed: Feb. 14, 2003

(65) Prior Publication Data

US 2003/0167713 A1 Sep. 11, 2003

Related U.S. Application Data

(63) Continuation-in-part of application No. 09/850,997, filed on May 8, 2001, now Pat. No. 6,519,906, which is a continuation-in-part of application No. 09/580,247, filed on May 26, 2000, now Pat. No. 6,240,692.

(51) Int. Cl.[7] ..... E04C 1/00

(52) U.S. Cl. ..... 52/309.11; 52/309.12; 52/426; 52/428

(58) Field of Search ..... 52/309.11, 309.12, 52/309.17, 425, 426, 428, 442, 562, 563, 565; 249/194, 191, 40, 44, 216

(56) References Cited

U.S. PATENT DOCUMENTS

| | | | | | |
|---|---|---|---|---|---|
| 1,240,436 | A | * | 9/1917 | Gendron et al. | 249/38 |
| 1,468,285 | A | * | 9/1923 | Francis | 52/259 |
| 1,552,334 | A | * | 9/1925 | Mosher | 249/219.1 |
| 1,890,532 | A | * | 12/1932 | Skolnik | 52/563 |
| 2,029,082 | A | * | 1/1936 | Odam | 52/275 |
| 2,248,348 | A | * | 7/1941 | Hall | 52/426 |
| 2,449,864 | A | * | 9/1948 | Symons | 249/190 |
| 2,967,689 | A | * | 1/1961 | Jahn | 248/205.1 |
| 3,888,456 | A | * | 6/1975 | Umstead | 249/219.2 |
| 4,210,306 | A | * | 7/1980 | Schimmel | 249/196 |
| 4,698,947 | A | * | 10/1987 | McKay | 52/309.12 |
| 4,750,308 | A | * | 6/1988 | McKay | 52/379 |
| 4,972,646 | A | * | 11/1990 | Miller et al. | 52/293.1 |
| 5,209,039 | A | * | 5/1993 | Boeshart | 52/699 |
| 5,649,401 | A | * | 7/1997 | Harrington, Jr. | 52/426 |
| 5,658,483 | A | * | 8/1997 | Boeshart | 249/191 |
| 5,845,455 | A | * | 12/1998 | Johnson, III | 52/713 |
| 6,378,261 | B1 | * | 4/2002 | Agsten | 52/426 |
| 6,519,906 | B2 | * | 2/2003 | Yost et al. | 52/426 |

* cited by examiner

*Primary Examiner*—Carl D. Friedman
*Assistant Examiner*—Basil Katcheves
(74) *Attorney, Agent, or Firm*—Armstrong, Kratz, Quintos, Hanson & Brooks, LLP

(57) ABSTRACT

A corner assembly for concrete form panels has a pair of rigid members. Each member has a bend therein to form a selected dihedral angle. Each member has horizontal slots formed therein and receiver plates which are received in the slots and extend through the concrete panel forms. The receiver plates are connected by a bridge member. The members are spaced apart by a selected distance and a removable bridge is disposed between the pair of rigid members. At least one concrete panel form is juxtapositioned to and connected to each of the rigid members. One of the rigid members is disposed exteriorly of the at least one concrete panel form. Concrete is disposed interiorly of the at least one concrete panel form. The corner assembly is adjustable to provide support for the corner of the construction.

18 Claims, 16 Drawing Sheets

CORNER ASSEMBLIES FOR CONCRETE FORM PANELS

CROSS REFERENCE TO RELATED APPLICATIONS

The present application is a continuation-in-part of U.S. application Ser. No. 09/850,997, filed May 8, 2001, now U.S. Pat. No. 6,519,906 which is a continuation-in-part of U.S. application Ser. No. 09/580,247 filed May 26, 2000 now U.S. Pat. No. 6,240,692, which are both incorporated in their entireties by reference hereto.

FIELD OF THE INVENTION

The present invention is directed to a concrete form assembly of panels which are spaced apart to form walls into which concrete is poured for construction purposes. More particularly, the present invention is directed to corner assemblies to support the panels.

BACKGROUND OF THE INVENTION

It is known that insulated polystyrene panels may be joined together to form walls which are interconnected with bridges so that two parallel walls are formed into which concrete may be poured for construction purposes. The parent application discloses prior art related to the blocks, inserts and bridges used in the construction of walls to retain the concrete.

The prior art has habitually resorted to the use of molded polystyrene corner pieces which, unfortunately, do not have the desired rigidity, strength and dimensional stability. The expanded needs to shrink or keep over time, especially during adverse weather conditions in storage. Nor can their respective dihedral angles be quickly changed without requiring the production of new molds, which is time consuming and expensive.

During this type of construction, it has been found that the weakest structural features occur at the corners where panels are disposed at angles to one another. The internal bracing does not fully support the forces of pressure applied to the corners when concrete is poured. It is frequently necessary to provide external bracing to the corners to prevent sag, deformation, separation or blowout of ht panels at the corners.

Holman, in U.S. Pat. No. 878,000, used two sides between which concrete was poured. Corner braces were employed to connect the two sides at the corners. In U.S. Pat. No. 1,240,436, Gendron et al formed two concrete walls with a hollow space between the walls. Sheet metal corner abutments were used at the interior corners of the hollow space between the walls. Odam, in U.S. Pat. No. 2,029,082 discloses a concrete wall which is formed from inner and outer slabs which are arranged in horizontal rows. The concrete is not poured between two forming walls. Boeshart in U.S. Pat. Nos. 4,916,879; 5,658,483 and 5,782,050 discloses corner ties for walls made with foampanels and concrete. The corner ties are marketed as FOLD FORM® and are sold by Fold Form, Inc., Sioux City, Iowa. The product is a molded plastic web with limited support external of the panels. The product is restricted to the dimensions provided and has no versatility to be adapted to various angles for the corner or varying spacing between the panel walls if the concrete portion of the wall is to have a greater or lesser thickness than preset in the product. A separate form is required if the corner angle or thickness of the concrete is varied. The product is disposed between two vertically abutting panels and the edges of the panels each must be provided with specially cut slots to receive straps in the product. In U.S. Pat. No. 5,564,235, Butler discloses a customized computer aided system which permits the floating of a foundation supporting wall and floor joists on adjustable supports. Fink in U.S. Pat. No. 5,820,477 discloses a connecting system used with boxes with connectors to form a corner.

There is a need for a versatile corner support which is usable for varying angles of corners and varying thicknesses of concrete wall. The corner support must be capable of being used with no, or only minimal, adaptation of ht panels. The corner support must provide sufficient support as to avoid the necessity for exterior bracing and to prevent sag, separation or blowout of the corner when concrete is introduced.

BRIEF SUMMARY OF THE INVENTION

It is an object of the present invention to provide a corner system which is versatile and can be used with varying corner angles and varying thicknesses of concrete.

It is another object of the present invention to provide a corner system which fully supports the form panels without further aids and avoids sag, deformation, separation and blowout of the corners.

In accordance with the teachings of the present invention, there is disclosed a form assembly used for concrete construction, wherein the concrete is poured between spaced-apart plastic form panels. The form panels are retained during the pouring of the concrete. The improvement is a metal corner assembly having two bent sheet metal members, an inner member and an outer member spaced apart a preselected distance. Each bent metal sheet metal member has at least one horizontal slot formed therein. The plastic form panels are received within the respective first and second metal members and retained thereby during the pouring of the concrete into the space between the respective plastic form panels. At least one receiver plate has a length, a wider end and an opposite narrower end, the narrower end having an opening therethrough. The narrower end of the at least one receiver plate is received in the at least one horizontal slot on the sheet metal member such that the opening in the narrower end extends through the plastic panel within the sheet metal member such that the at least one receiver plate is approximately perpendicular to the bent sheet metal member. The at least one receiver plate has a stop means on the wider end. At least one bridge member has a length, a bent first end and a bent opposite second end. The bent first end of the at least one bridge is received in the opening in the at least one receiver plate in the outer bent sheet metal and the second bent end of the at least one bridge member is received in the opening in the at least one receiver plate in the inner bent sheet metal member. The inner and outer sheet metal members are secured and spaced apart by the preselected distance.

In further accordance with the teachings of the present invention, there is disclosed a form assembly used for concrete construction, wherein the concrete is poured between spaced-apart plastic form panels. The form panels are retained during the pouring of the concrete. The improvement is a metal corner assembly having two bent sheet metal members, an inner member and an outer member spaced apart a preselected distance. Each bent metal sheet metal member has a plurality of spaced-apart horizontal slots formed therein. The plastic form panels are received within the respective first and second sheet metal members and retained thereby during the pouring of the concrete into the space between the respective plastic form panels. A plurality of right angle receivers are provided, each right angle receiver being a plate having a tapered end and an opposite end. The plate has a right angle bend between the ends. A through hole is formed in the tapered end. The tapered end is received in a respective selected horizontal slot in the sheet metal member such that the opening in the narrower end extends through the plastic panel within the sheet metal member. A bridge member has a length, a bent first end and an opposite bent second end. The bent first end of the bridge is received in the opening in the right angle receiver in the outer sheet metal member and the bent second end of the bridge is received in the opening in the right angle receiver in the inner sheet metal member such that the inner and outer sheet metal members are secured and spaced apart by the preselected distance.

In still further accordance with the teachings of the present invention, there is disclosed a corner assembly for concrete form panels. A rigid member has an inner face and a bend therein forming a selected dihedral angle having a first side and a second side. At least one horizontal slot is formed in the first side and at least one horizontal slot is formed in the second side. A pair of plastic panels are disposed in juxtaposition to one another within the first side and the second side of the rigid member. At least one first receiver plate passes through the at least one horizontal slot in the first side and a portion thereof projects beyond the plastic panel within the first side. At least one second receiver plate passes through the at least one horizontal slot in the second side and a portion thereof projecting beyond the plastic panel within the second side. Said projecting portions of the at least one first receiver plate and the at least one second receiver plate, each have an opening formed therein. At least one bridge has a downwardly bent first end and a downwardly bent second side. The respective ends of the at least one bridge are received in the respective openings in the at least one first receiver plate and in the at least one second receiver plate. In this manner, the plastic panels are secured within the inner face of the rigid member.

Additionally, in accordance with the teachings of the present invention there is disclosed a building structure, wherein concrete is to be poured into a form at a corner of the building structure, and wherein the form includes at least one pair of plastic panels disposed in juxtaposition to each other. The improvement is an external corner reinforcement including a pair of integrally-formed side members forming a dihedral angle therebetween. At least one of the side members of the external corner reinforcement are disposed adjacent to one of the plastic panels. Said one side member has an opening formed therein. A first receiver plate passes through said one side member and through said one plastic panel and has a portion projecting therebeyond. Said projecting portion of the receiver plate has an opening formed therein. Stop means limits the passage of the receiver plate through the said one plastic panel. The other plastic panel has a second receiver plate anchored therein. Said second receiver plate has a portion projecting beyond said other plastic panel and has an opening formed therein. A bridge has a pair of ends bent downwardly at an angle to the bridge, such that the ends of the bridges are received in the respective openings of the first and second receiver plates.

Furthermore, in accordance with the teachings of the present invention, there is disclosed a building structure, wherein concrete is to be poured into a form at a corner of the building structure, and wherein the form includes a pair of plastic panels disposed in abutting relationship transversely to each other. The improvement is an external corner reinforcement formed of bent sheet metal and including a pair of integrally-formed side members forming a dihedral angle therebetween. Each side member of the external corner reinforcement is disposed adjacent to one of the plastic panels and externally thereof. Each side member has at least one opening formed therein. A pair of retainers includes one for each plastic panel. Each retainer is inserted through a respective opening in a respective side member and through the respective plastic panel. External stop means limit the passage of the retainer through the opening in the respective side member. The retainer has a portion thereof projecting beyond the respective plastic panel. The projecting-portion of the retainer has an opening formed thereon. A bridge has a pair of ends bent downwardly at an angle to the bridge. The ends of the bridge are received in the respective openings of the receivers, thereby anchoring the external corner reinforcement to the plastic panels.

Also, in accordance with the teachings of the present invention, there is disclosed a corner assembly for concrete form panels having a pair of rigid members. One member has an inner face and a bend therein forming a selected dihedral angle. The other member is formed from a pair of submembers. The rigid members are spaced apart by a selected distance. The pair of rigid members each has a height ranging from six inches to eight feet. At least one connector is disposed along the height of the pair of rigid members only between the respective bends in the pair of rigid members. At least one concrete form panel comprises a prefabricated plastic panel juxtapositioned to each of the rigid members wherein the concrete form panels may be spaced apart a varying distance, even within a same construction, forming cavities of differing thicknesses. Concrete is disposed adjacent to each of the at least one concrete form panels. The corner assembly retains the concrete form panel without external bracing and without risk of sag, deformation, separation or blowout of the corner assembly.

Still further in accordance with the teachings of the present invention, there is disclosed in a form for concrete construction, the combination of two pairs of concrete form panels spaced apart a preselected distance, including an inner pair and an outer pair disposed radially therefrom. Each pair includes a pair of form panels disposed in an angular relationship with respect to each other and forming a respective dihedral angle therebetween. At least one bent sheet metal reinforcing member is disposed exteriorly of the outer pair of concrete form panels and abutting thereto, thereby forming a secure corner assembly. The concrete may be poured into the space between the two pairs of concrete form panels without risking a sag, deformation, separation or blowout of the corner assembly nor requiring external bracing thereto.

There is further disclosed a corner assembly for concrete form panels having a pair of rigid members. Each member has an inner face and a bend therein forming a selected dihedral angle. The rigid members are spaced apart by a selected distance. A foot plate is disposed at the base of the corner assembly and connected substantially perpendicularly to the corner assembly to serve as a pivot point for adjusting the corner assembly. At least one concrete panel form is juxtapositioned, and connected to each of the rigid members and concrete disposed adjacent to each of the at least one concrete form panels. The corner assembly retains the concrete form panel without external bracing and without risk of sag, deformation, separation or blowout of the corner assembly.

In another aspect there is disclosed a method of concrete construction. A plurality of form panels are provided. A corner assembly is provided having at least one member having a bend therein forming a selected dihedral angle. Two of the form panels are disposed at the selected dihedral angle with respect to one another, the form panels being juxtapositioned to the corner assembly. Concrete is disposed against the two form panels wherein the at least one member of the corner assembly is distal from the concrete and retains the form panels at the selected dihedral angle without external bracing and without risk of sag, deformation, separation or blowout of the corner assembly.

In still another aspect, there is disclosed a corner assembly for concrete form panels having a pair of flat rigid members. Each member has an inner face and a bend therein forming a selected dihedral angle. The rigid members are spaced apart by a selected distance. A bridge is disposed between the pair of rigid members. A concrete form panel is juxtapositioned to, and connected to the inner face to each of the rigid members. Concrete is disposed adjacent to each of the concrete form panels wherein the concrete avoids contact with the pair of rigid members. The corner assembly retains the concrete form panel without external bracing and without risk of sag, deformation, separation or blowout of the corner assembly.

Further in accordance with the teachings of the present invention, there is disclosed a structure having a corner assembly for a form for the pouring of concrete, wherein with the concrete is poured between plastic panels. The improvement is a first bent rigid reinforcing plate exteriorly of and adjacent to a first set of plastic panels, a second bent rigid reinforcing plate, spaced from the first bent rigid reinforcing plate, and having a second set of plastic panels adjacent thereto. Each rigid reinforcing plate is bent at a selected dihedral angle, the bend in the rigid reinforcing plates being inserted in a same direction. The concrete is poured between the respective panels. The first and second bent rigid reinforcing plates has respective bends defining the corner assembly of the structure. A bridge has a selected length connected the first and second bent rigid reinforcing plates only at the respective bends thereof. Changing the length of the bridge, provides for adjustability between the respective first and second bent rigid reinforcing plates, and thereby the adjustability of the thickness of the concrete wall.

In yet another aspect, in accordance with the teachings of the present invention, there is disclosed a method of concrete construction. A plurality of form panels are provided. A pair of rigid members are provided; an inner member and an outer member. Each rigid member has a bend therein forming a selected dihedral angle. Each rigid member has at least one slot formed horizontally therein. A plurality of form panels are provided. Two pair of the form panels are disposed at the selected dihedral angle. One pair is juxtapositioned to the inner member and the outer pair is juxtapositioned to the outer member wherein the pairs of form panels are opposite from one another. At least two receiver plates are provided. Each receiver plate has a length, a wider end and an opposite narrower end. The narrower end of each receiver plate has an opening therethrough. At least one receiver plate is inserted in the at least one horizontal slot in the outer rigid member and through the form panel such that a portion of the narrower end of the receiver plate with the opening therein projects beyond the form panel. The step of inserting at least one receiver plate in the inner rigid member and the form panel as above is repeated. A bridge having downwardly turned ends is provided. The respective ends of the bridge are inserted into the respective openings in the projecting portions of the receiver plates. Concrete is poured between the opposing pairs of form panels and over the bridge therebetween. The concrete is allowed to set up.

Accordingly, it is the primary object of the present invention to provide the optimum combination of plastic and metal to quickly and economically produce a variety of corner assemblies having the desired rigidity, flexibility, strength and dimensional stability consonant with relatively low cost and minimum tooling instruments.

These metal corners are quite strong, and thus the external bracing requirements are minimized if not eliminated altogether.

Moreover, contractors who are even minimally familiar with concrete construction (using the expanded forms) will readily appreciate the inherent features and advantages of the corner assemblies of the present invention without requiring demonstrations and an educational process, other substantially reducing initial marketing costs.

These and other objects of the present invention will become apparent from a reading of the following specification taken in conjunction with the enclosed drawings.

These and other objects of the present invention will become apparent from a reading of the following specification taken in conjunction with the enclosed drawings.

DESCRIPTION OF THE PREFERRED EMBODIMENTS

In the construction of a building using the insulated polystyrene panels to form two parallel walls with concrete between the panels, problems arise at the corners of the walls. In the present state-of-the-art construction procedures, two panels formed from expanded polystyrene block are butted together to form the desired angle. In some instances, external bracing is needed at the corners before the concrete is poured and the bracing is removed when the concrete has set. This is a time consuming, labor intensive, costly procedure. The device of U.S. Pat. No. 4,916,879 has been marketed to address this problem but has the limitations discussed previously.

Figure 1:
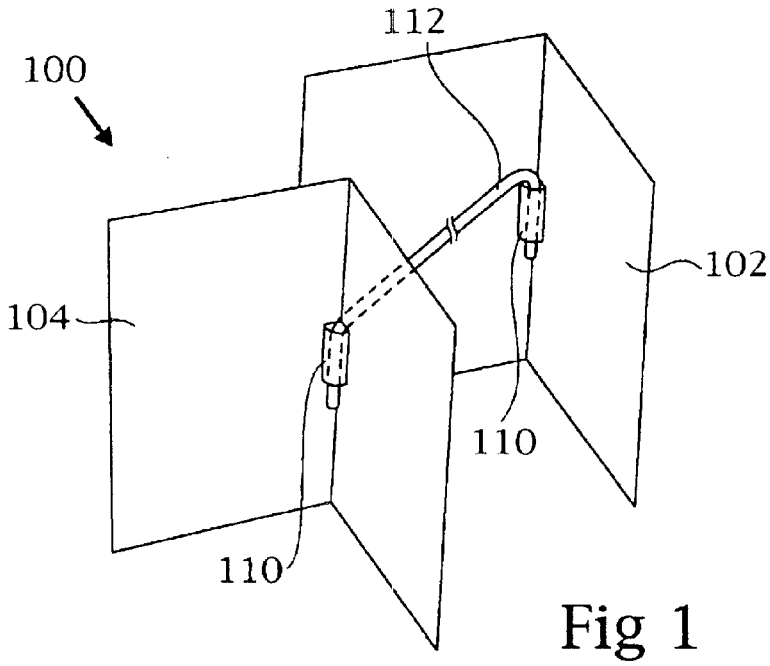
FIG. 1 is a perspective view of one embodiment of the present invention showing two connected corner members forming a corner assembly.

The present invention recognizes these problems and provides a solution. Corner assemblies 100 are formed from a pair of complementary members 102, 104, each member having an inner face and being bent at a selected dihedral angle (FIG. 1). Preferably, the members 102, 104 are bent at an angle of 90° but the bend could be at other angles depending upon the construction required. The members 102, 104 are formed from a rigid material. Preferably, the rigid material is sheet metal but plastic having sufficient rigidity may be used. If the material is metal, galvanized iron is preferred. The thickness of the members 102, 104 is selected based on the specific requirements of the construction. Although not limited, a thickness of 24–28 gauge is preferred. The first member 102 is adjustably connected to the second member 104 by means which will be described. At least one concrete form panel 106 is disposed adjacent to each member 102, 104 of the pair such that the respective ends 106 of the concrete form panels above placed at a dihedral angle with respect to each other which corresponds to the angle at which the members 102, 104 are bent. In most construction, the angle is 90°, but for some uses, acute and/or obtuse angles may be required.

Figure 2:
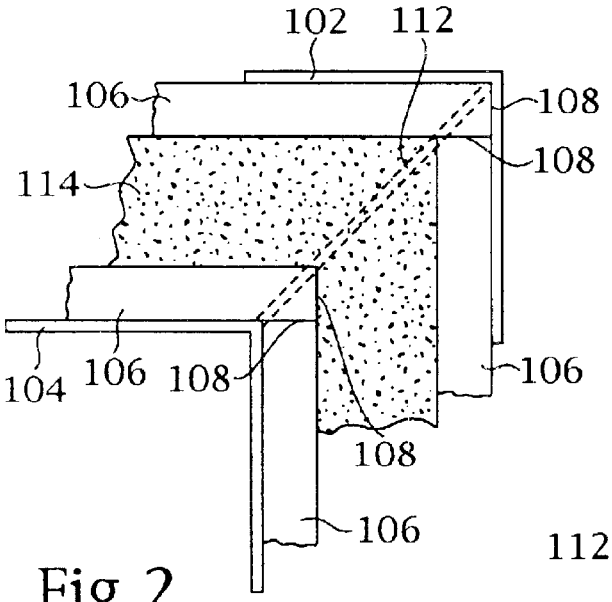
FIG. 2 is a top plan view showing form panels disposed adjacent to each of the corner members with concrete disposed therebetween.

Referring to FIG. 2, the first member 102 is spaced apart from the second member 104 by a distance dependent upon the thickness of the concrete and of the panels which is required for the construction. Each member 102, 104 has at least one inwardly lanced-out eyelet 110 formed internally at the bend of the respective member.

A tie rod 112, preferably in the shape of an inverted U-shaped bridge, is disposed between the members 102, 104 and has right angle bends therein defining a length. The length corresponds to the distance required between the members and can be made at the construction site or can be preformed to provide versatility and flexibility to the system. The ends of the bridge 112 are bent at right angles and are received in the inwardly lanced-out eyelets 110 in the respective members 102, 104 to connect the outer side of the second member 104 to the inner side of the first member. The lanced-out eyelets 110 are formed so that the members 102, 104 may be connected by the bridge 112 even when the members 102, 104 are inverted with respect to one another.

Figure 3:
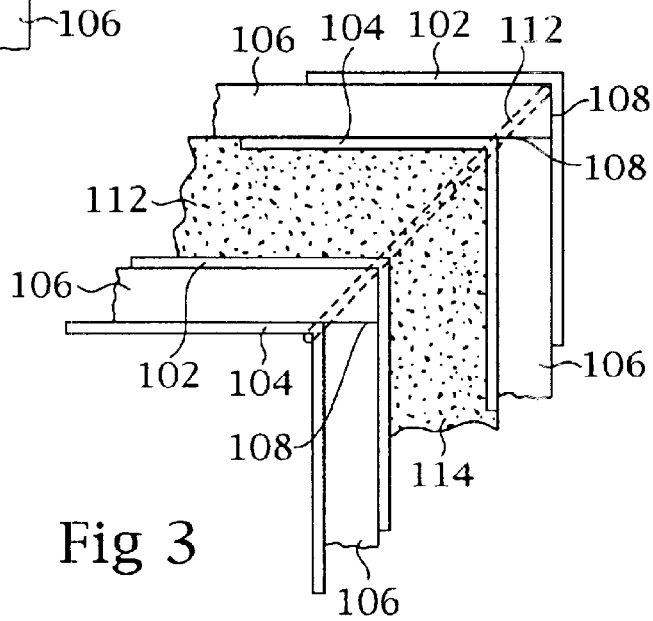
FIG. 3 is a top plan view showing two corner assemblies with form panels disposed in each corner assembly and concrete disposed between the two corner assemblies.
Figure 7:
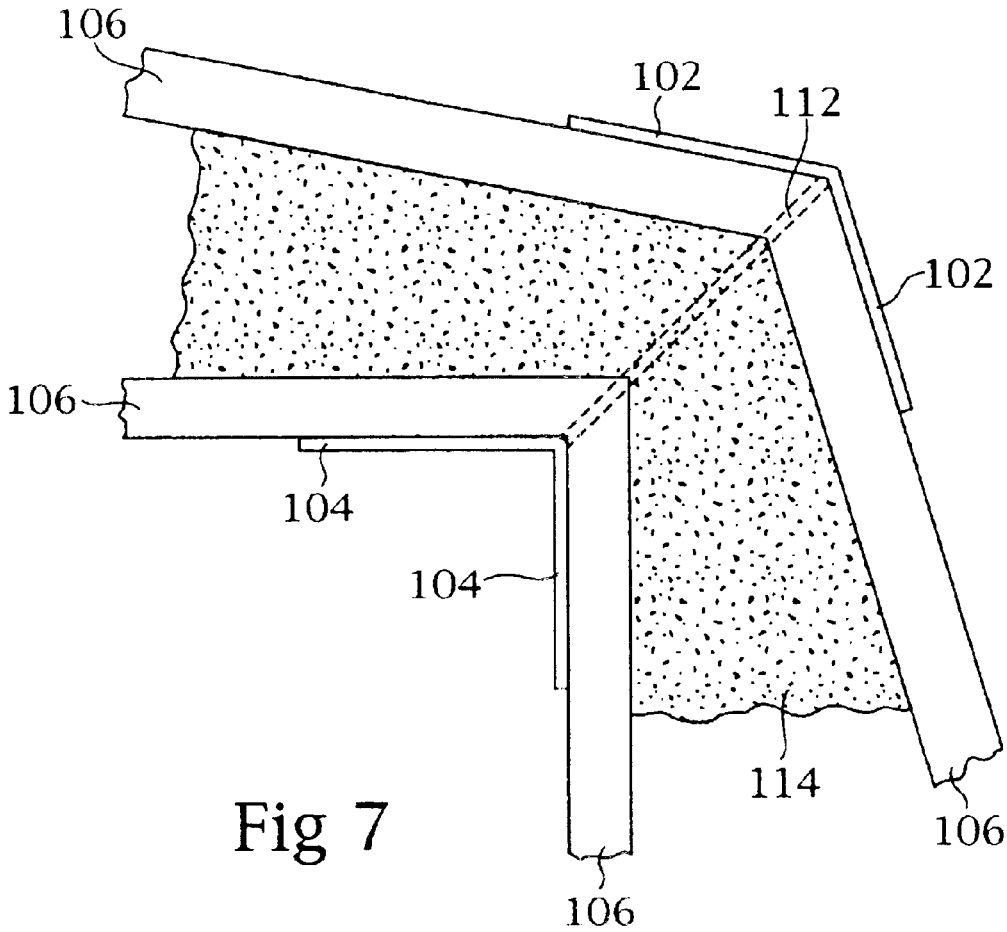
FIG. 7 is a top plan view showing the dihedral angle of the first pair of members at a different dihedral angle from the second pair of members.

As shown in FIG. 3, two corner assemblies, each consisting of a pair of members 102, 104 are combined to form an overall corner assembly. An inner pair of members 102, 104 is spaced apart from an outer pair of members. Concrete form panels 106 are juxtapositioned to the inner face of each member 102 of each pair with the respective ends 108 of the form panels 106 at an angle corresponding to the angle of the member 102, 104. The inner face of a member is defined herein as the face of the respective member which is opposite and proximal to the other member. The outer face of a member is the face which is the inverse of the inner face and is distal from the other member. The term "exterior" as used herein is defined as the portion of the construction which is viewed from the outside of the construction. The exterior corresponds to the largest surface area of the corner which is exposed to hydraulic forces of the concrete and where support is most necessary. The term "interior" as used herein is defined as the portion of the construction which is viewed from within the building or construction. Depending upon the construction requirements, the dihedral angle of the first member may be different from the dihedral angle of the second member (FIG. 7). The individual assemblies, each having members 102, 104 are connected by the tie rod 112 and concrete 114 is poured between the concrete form panels 10.

Figure 4:
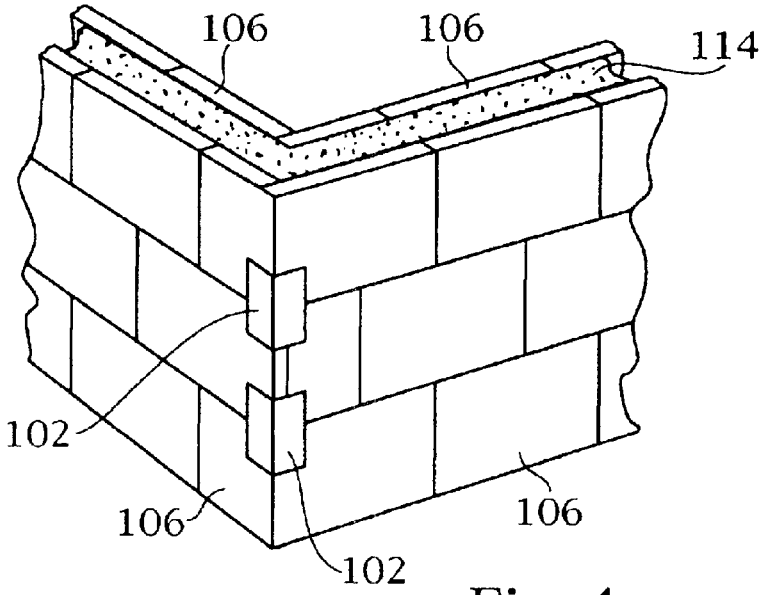
FIG. 4 is a perspective view of the outside of a wall having the corner assembly of the present invention disposed therein.

FIG. 4 shows the present invention disposed in the corner of a wall formed of concrete form panels 106. The size of the bent member 102 of the corner assembly 100 is such that adequate support is provided to the wall and may be selected depending upon the specific requirements. It is preferred that each member 102 have a height of approximately six (6) inches and each bent portion have a width of approximately five (5) inches although these dimensions may be varied. The members may have widths which are different from each other such that the member has an "L" shape. In most instances, it may be desirable for each member to have a height of up to eight (8) or more feet. The corner assemblies 100 may be spaced apart vertically or butted together to provide a corner assembly of any desired height.

Figure 5:
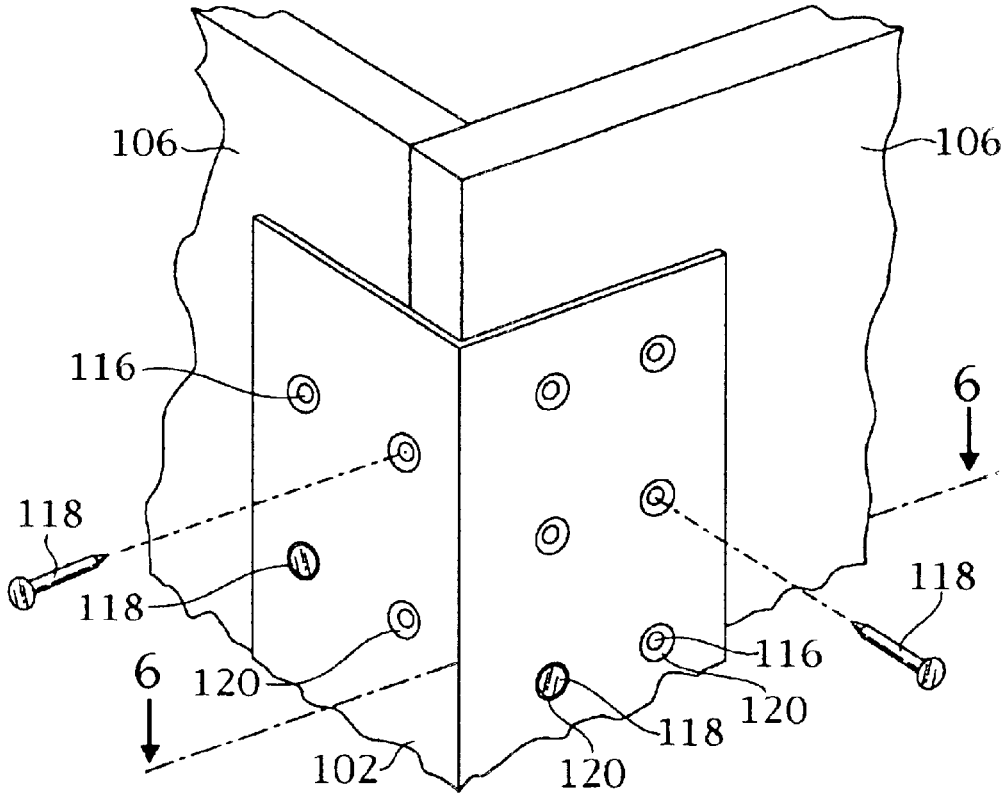
FIG. 5 is a perspective view of the corner assembly connected to the form panel by the elongated shank.
Figure 6:
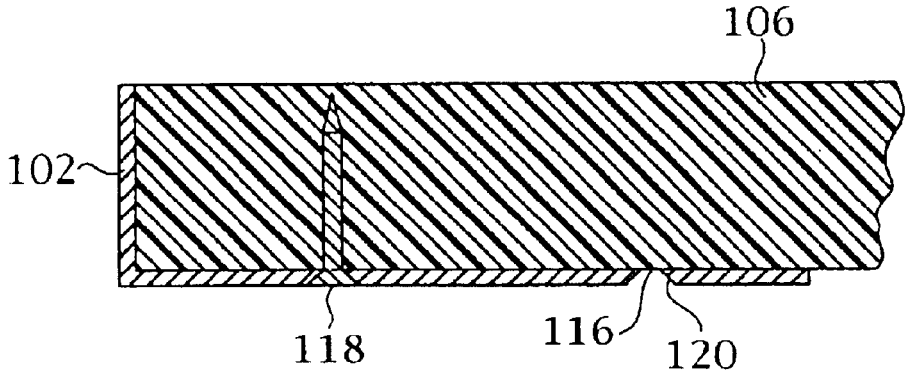
FIG. 6 is a cross-sectional view taken across the lines 6—6 of FIG. 5.

A plurality of spaced-apart tie-in openings 116 are formed in the faces of each of the rigid members 102, 104 (FIGS. 5 and 6). At least one elongated shank 118 is disposed in at least one of the tie-in openings in each rigid member. The elongated shank 118 extends through the respective member 102, 104 and into the adjacent polystyrene concrete form panel 106 to connect the respective member to the form panel 106 and minimize any movement between the corner assembly 100 and the adjacent form panel 106. Preferably, the elongated shank 118 has a sharpened end and a head at an opposite end. The sharpened end is lodged within the form panel 106 and the head is disposed exteriorly of the member 102, 104 wherein the tie-in opening is countersunk 120 so that the head of the shank 118 is substantially flush with the plane of the member 102, 104. The elongated shank 118 may be a nail, a spike, a screw, a rod or other means known to persons skilled in the art. The tie-in openings 116 are disposed in the members 102, 104 such that the shanks 118 in one portion of the member do not interfere with or contact the shank in the angled other portion of the member when the respective shanks 118 are lodged within the adjacent form panels 106. It is preferred that the shanks 118 be "toed-in" to lock the panels 106 to the corner assemblies 100. The length of the shank 118 is not critical. The shank 118 may terminate within the panel 106 or may extend completely through the panel 106 and terminate within the cavity in which the concrete is placed. If the shank so extends, it further anchors the corner assembly. The number of shanks 118 to be used are determined by the nature of the specific construction. It is preferred that all of the embodiments of the rigid members have the plurality of spaced-apart tie-in openings 116 formed therein.

It is also preferred that at least a portion of an outer face of the corner assembly 100 be colored wherein it is readily apparent where the corner assemblies have been installed. Any color may be used. The color may be preformed or the color may be applied by any means known to persons skilled in the art.

Figure 8:
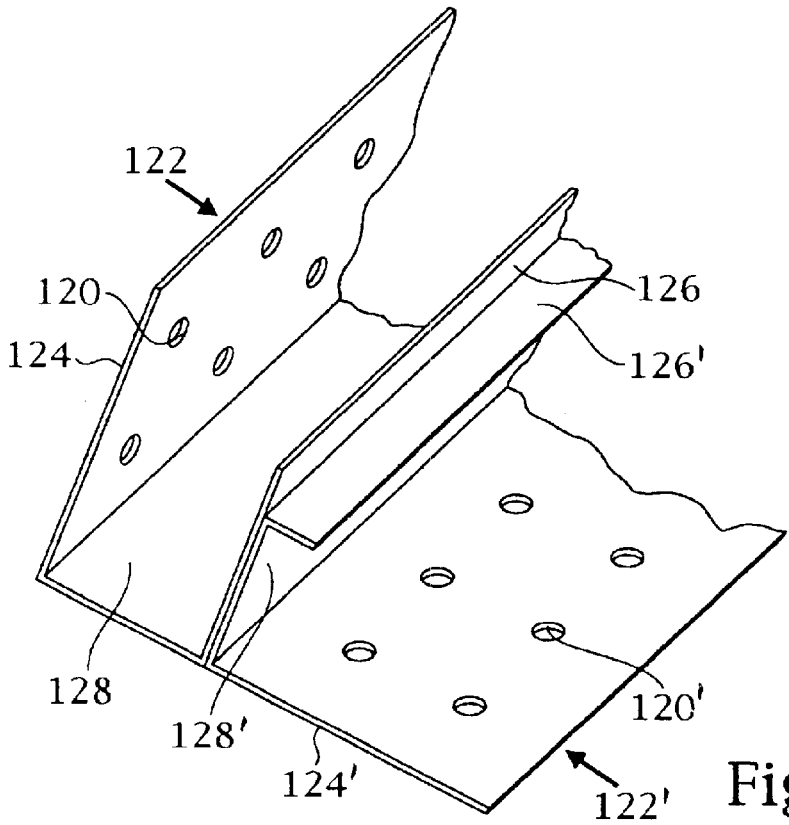
FIG. 8 is a perspective view of an alternate embodiment which has two J-shaped members.
Figure 9:
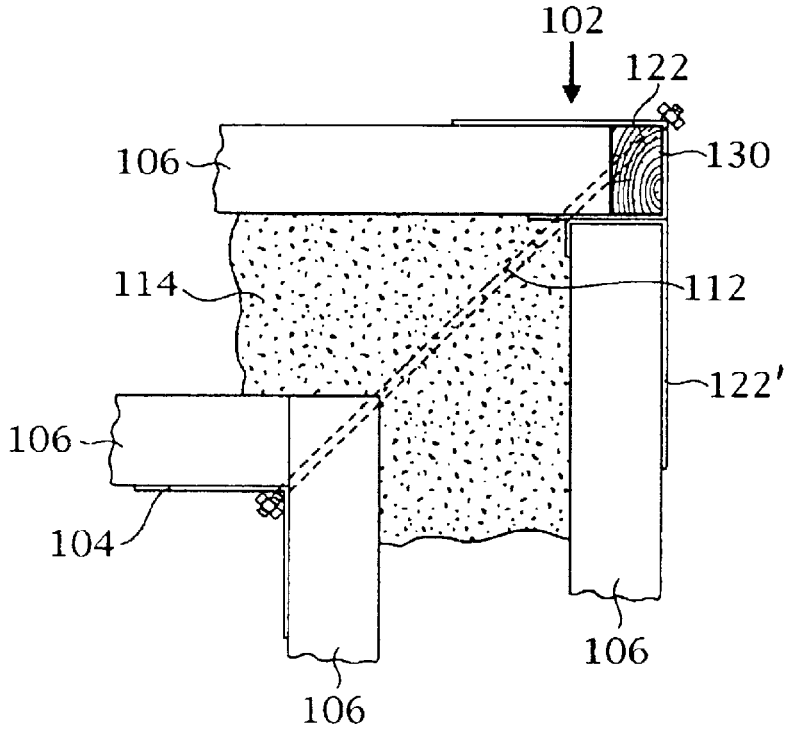
FIG. 9 is a top plan view showing a corner assembly having two connected J-shaped members with concrete form panels and concrete received therein.
Figure 10:
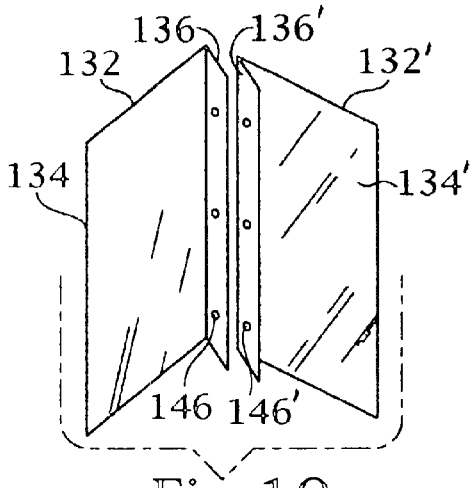
FIG. 10 is a perspective view of two submembers of a first member of the corner assembly.
Figure 11:
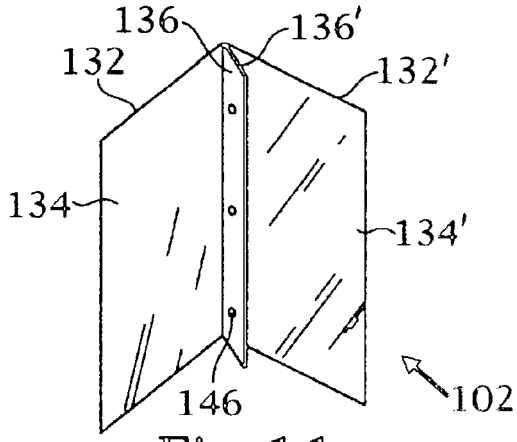
FIG. 11 is a perspective view showing the two submembers of FIG. 10 mated.
Figure 12:
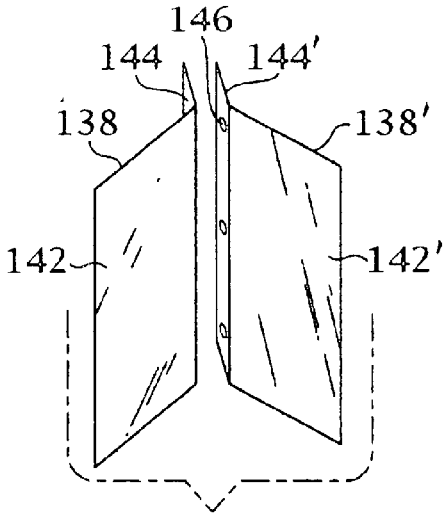
FIG. 12 is a perspective view of two submembers of a second member of the corner assembly.
Figure 13:
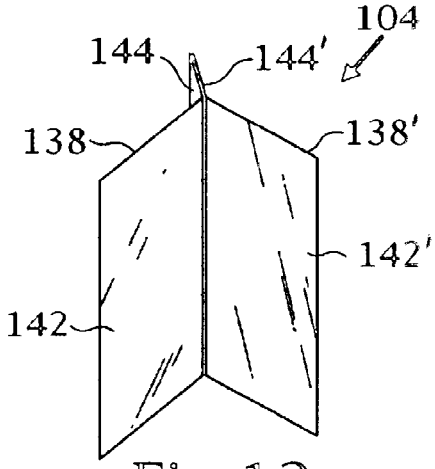
FIG. 13 is a perspective view showing the two submembers of FIG. 12 mated.
Figure 14:
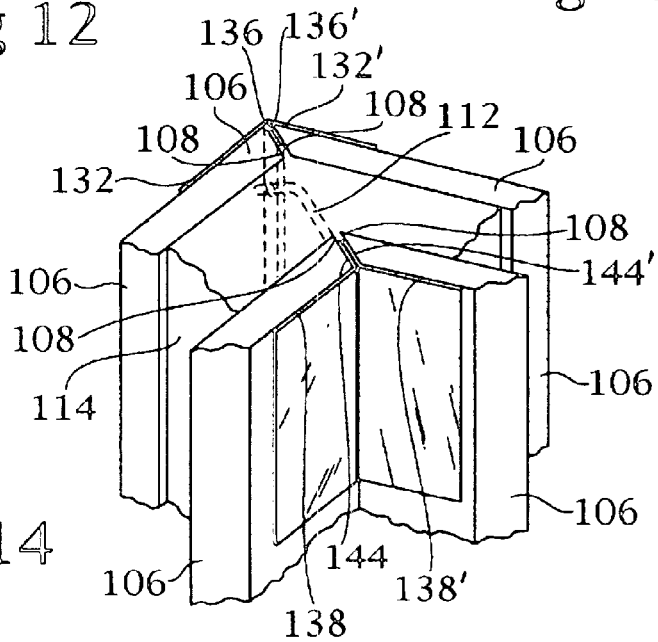
FIG. 14 is a top plan view showing the submembers of FIGS. 11 and 13 supporting concrete form panels and concrete therebetween.

In another embodiment (FIG. 8) the first member 102 is formed from submembers. Each submember 122 has a "J" shape. One submember 122 has a long leg 124, a short leg 126 and a base 128 therebetween. The one submember is disposed with the long leg 124 exteriorly and the base 128 forming a right angle at the corner. The base 128' of the other submember 122' is abutted and connected to the short leg 126 of the one submember, the long leg 124' of the other submember 122' being substantially flush with the base 128 of the one submember 122. The connection between the submembers 122, 122' may be nut and bolt, welding, riveting, adhesive or any means known to persons skilled in the art. A concrete form panel 106 is received between the legs 124, 126 of one of the submembers and another of the concrete form panels 106 is received between the legs 124', 126' of the other submember 122' (FIG. 9). Spaced apart from the first member 102, at a preselected distance, is the second member 104 of the corner assembly 100. The second member 104 may be similar to the first member 102 but may also be a right angle section of metal of a necessary length as will be described.

Figure 16:
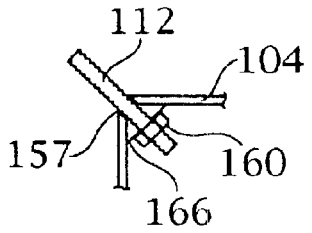
FIG. 16 is a perspective view of the end of the threaded bridge connected to the second member with a fastener and wedging the shelf in place.

A bridge or tie rod 112 is removably connected to the first member 102 and the second member 104 to minimize movement between the members and also to maintain spacing between the members 102, 104. The bridge 112 has a length which is adjusted to provide a desired thickness of concrete which is poured between the form panels 106 adjacent to the first member 102 and the second member 104. The bridge 112 may have ends which are bent to be received in openings in the first 102 and second 104 members. Alternately, the bridge 112 may be threaded and have cooperating nuts, sleeves or other means to adjust the length and to secure the bridge 112 of respective openings in the first member 102 and the second member 104 (FIG. 16).

With the alternate embodiment having "J" shaped submembers 122, 122', preferably a supporting means 130 is disposed vertically within the corner assembly 100 to provide vertical support to the corner assembly 100. As shown in FIG. 9, the supporting means 130 may be a wooden or metal beam, preferably having a length of several feet and extending vertically in support of a plurality of concrete form panels and a plurality of corner assemblies. A plurality of support means 130 may be abutted end to end to provide vertical support to a wall which has a height of many feet. If the support means 130 is formed from wood, it can also serve as an additional nailing flange for the corner assembly.

In another embodiment as shown in FIGS. 10–14, the first rigid member 102 is formed from a first submember 132 and a second submember 132'. Each submember has a longer side 134, 134' and a shorter side 136, 136', there being a 45° angle between the longer side 134, 134' and the shorter side 136, 136'. The shorter sides 136, 136' of the submembers abut and connect to one another such that the longer sides 134, 134' form a 90° outer corner. A first concrete panel form 106 having a side formed at a 45° angle is disposed adjacent to the 45° angle of the first submember 132, a second concrete form panel 106 having a side formed at a 45° angle is disposed adjacent and side-by-side to the 45° angle of the second submember 132' such that the 45° angle sides of the first concrete form panel 106 cooperate with the 45° angle side of the second concrete form panel 106. The concrete form panels 106 are disposed perpendicular to one another interiorly of the longer sides 134, 134' of the respective submembers 132, 132'. The second rigid member 104 is formed from a first submember 138 and a second submember 138'. Each submember 138, 138' has a longer side 142, 142' and a shorter side 144, 144', there being a 135° angle between the longer side 142, 142' and the shorter side 144, 144'. The shorter sides 144, 144' of the submembers 138, 138' abut and connect to one another. The longer sides 142, 142' form a 90° inner corner. A first concrete form panel 106 having a side formed at a 135° angle is disposed adjacent to the 135° angle of the first submember 138, a second concrete form panel 106 having a side formed at a 135° is disposed adjacent to the 135° angle of the second submember 142' such that the respective 135° angle side of the first concrete panel form cooperates with the 135° angle side of the second concrete panel form. The concrete panel forms are disposed perpendicularly to one another. Angles of 45° and 135° are provided as operative examples. The angles could vary depending upon specific construction requirements where the corners are not formed at 90°. The second rigid member 104 is spaced apart from the first rigid member 102 by a selected distance. The shorter sides 136, 136' of the first rigid member 102 and the shorter sides 144, 144' of the second rigid member 104 have respective openings formed therein. At least one bridge 112 having bent ends and a length corresponding to the distance between the spaced-apart first 102 and second 104 rigid members, is removably disposed between the first 102 and second rigid members 104. The bent ends of the at least one bridge 112 are received in openings 146, 146' in the shorter sides 136, 144 of the respective rigid members 102, 104 such that the first rigid member 102 is connected to the second rigid member 104. Concrete 114 is disposed between the respective concrete form panels 106 adjacent to the first rigid member 102 and the second rigid member 104.

Figure 15:
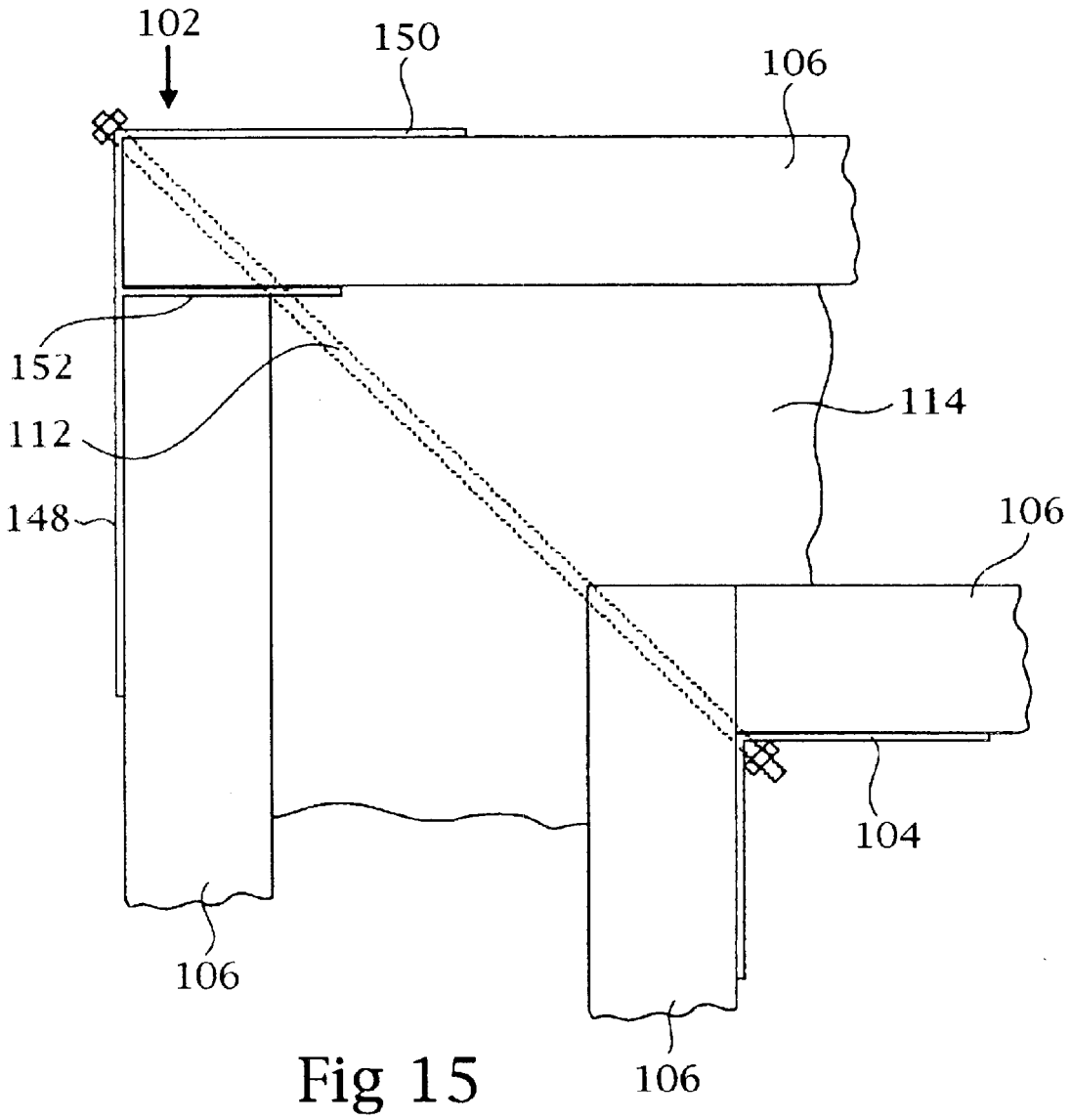
FIG. 15 is a top plan view showing an F-shaped member with concrete form panels adjacent to the member.

In still a further embodiment (FIG. 15), the first rigid member 102 has a leg 148 to which are connected at right angles, an upper arm 150 and an intermediate arm 152 defining a "F" shape. A first concrete form panel 106 is disposed between the upper arm 150 and the intermediate arm 152. A second concrete form panel 106 is disposed parallel to the leg 148, abutting a lower surface of the intermediate arm 152. The second rigid member 104 is spaced apart from the first rigid member 102 by a selected distance and concrete form panels 106 are disposed adjacent to the second rigid member 104. At least one bridge 112 is removably connected between the first rigid member 102 and the second rigid member 104. The length of the bridge 112 corresponds to the selected distance between the first member 102 and the second member 104. Concrete 114 is disposed between the respective concrete form panels 106 adjacent to the first rigid member 102 and the second rigid member 104.

The second member 104 of the corner assembly 100 preferably has a plurality of openings 157 formed therein. The openings 157 are formed at the bend of the second member 104 and are spaced apart vertically at periodic intervals. Tie-in openings 116 are formed on the submembers at periodic intervals. The bridges 112 between the first member 102 and the second member 104 are received in the selected openings 157 at the bend in the second member 104 and protrude inwardly. A fastening means 160 is threadingly received on the bridge 112 and is tightened to secure the members 102, 104. A plurality of shanks 118 may be inserted through the tie-in openings 116 and into the concrete form panels 106 as previously described.

Figure 17:
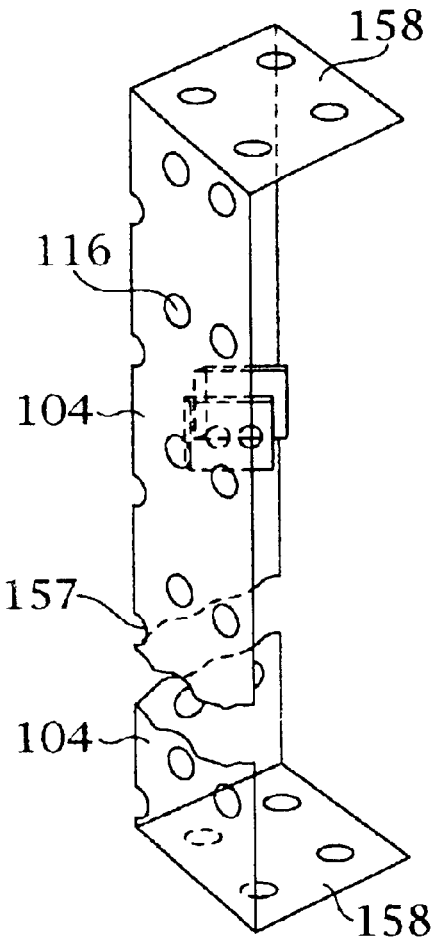
FIG. 17 is a perspective view showing the second member having a foot plate and a clip.
Figure 18:
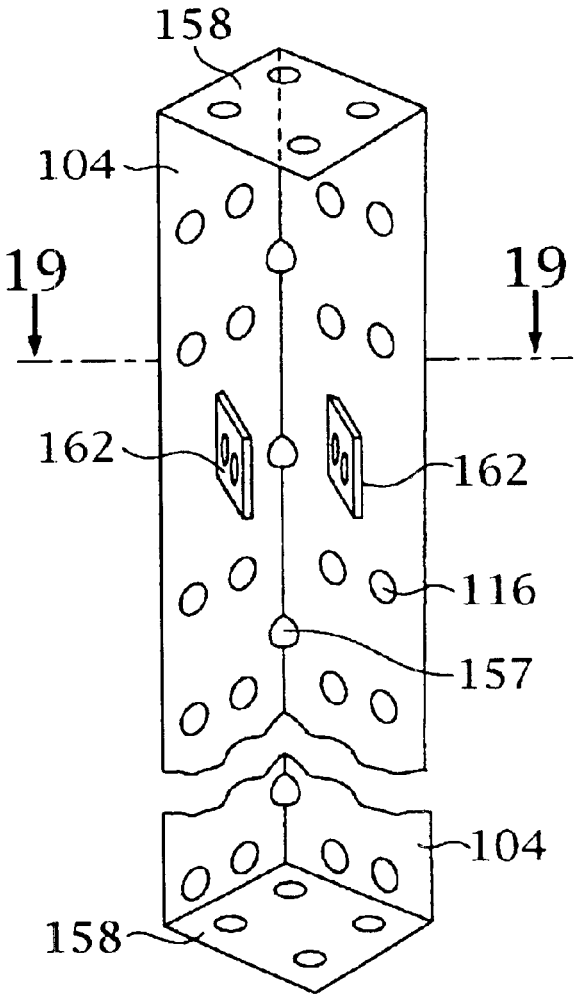
FIG. 18 is a perspective view of the inside of the right angle second member showing the foot plate, shelves and clip.
Figure 19:
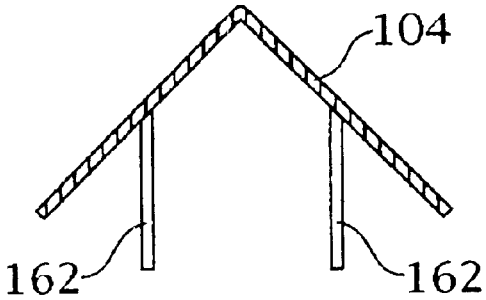
FIG. 19 is a cross-section view taken across the lines 18—18 of FIG. 17.
Figure 20:
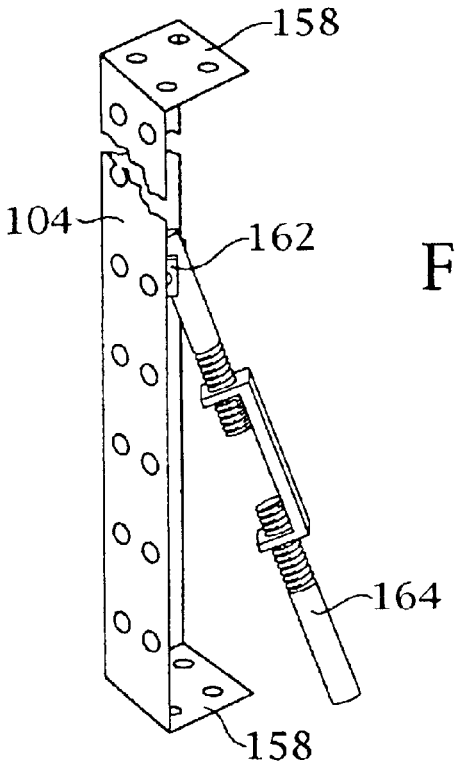
FIG. 20 is a perspective view of an adjustable brace received in the clip on the second member.
Figure 21:
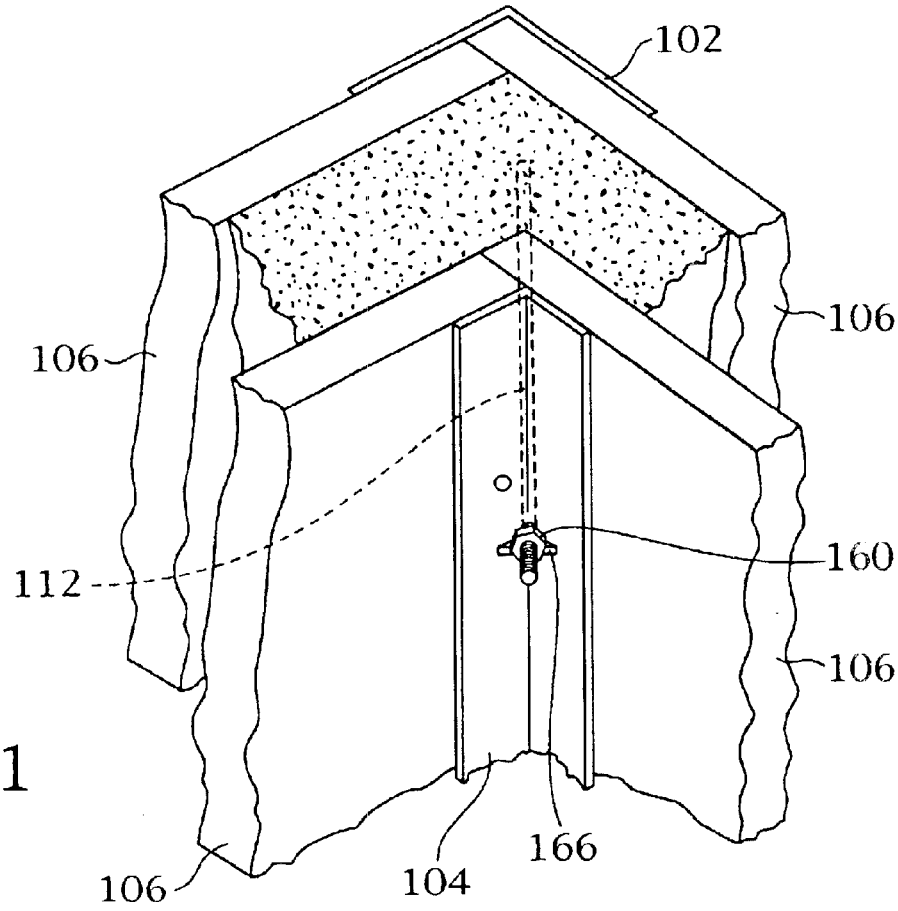
FIG. 21 is a perspective view from the interior of the construction showing the corner assembly.

In order to assist in adjusting the corner assemblies 100 to assure the tolerances of the construction, it is desirable to form a plate 158 at the base of the corner assembly 100 as shown in FIGS. 17–19. Preferably, the second member 104 may be a right angle metal section of a selected length. The plate 158 is connected to the lower end of the second member 104 and anchored to the floor or base of the construction. In this position, the plate acts as a pivot point for minor adjustments required to maintain the entire corner and corner assembly 100 in a plumb condition. A plate 158 may also be connected to the upper end of the second member 104. In this manner, two or more second members 104 may be abutted and connected end to end to form a member having a desired height which has increased stability and rigidity. A U-shaped clip 162 is secured to the second member 104 at a selected height above the foot plate 158. Preferably, the clip 162 has an opening formed in each leg of the U-shape. An adjustable brace 164 is connected between the U-shaped clip 162 and the floor to provide fine adjustments to the alignment of the corners (FIG. 20). The brace 164 is used to support the second member 104 during the construction phase and is removed when no longer required. The brace 164 may be a single unit but preferably has a turnbuckle to more easily adjust the length of the brace 164 as required to adjust the plumb of the construction.

Also, as shown in FIG. 16, a shelf 166 having a triangular shape is disposed in the bend of the second member 104 juxtapositioned to the bridge 112. The fastener 160 is tightened against the side of the triangular shelf 166 to wedge the shelf 166 within the bend in the second member 104 to further stabilize the construction.

The first member 102 of most of the embodiments is easily formed from sheet metal. The thickness (gauge) of the sheet metal is selected based on the strength anticipated by the construction. The corner assembly is not temperature sensitive and the metal members are fire proof. The corner assembly may be formed into any desired angle and the members may be spaced apart by any desired distance. The tie bars to provide support are inexpensive and can be easily formed to any desired length required by the peculiarities of the construction. Even within the same construction, a variety of angles and thickness of walls and corners can be formed. The components can be formed at a location distant from the construction site and easily and economically transported to the site because the components may be nested or stacked conveniently. The corner assembly can be assembled by persons having a relatively low level of skills. Little or no adaptation of standard panels is required.

Figure 22:
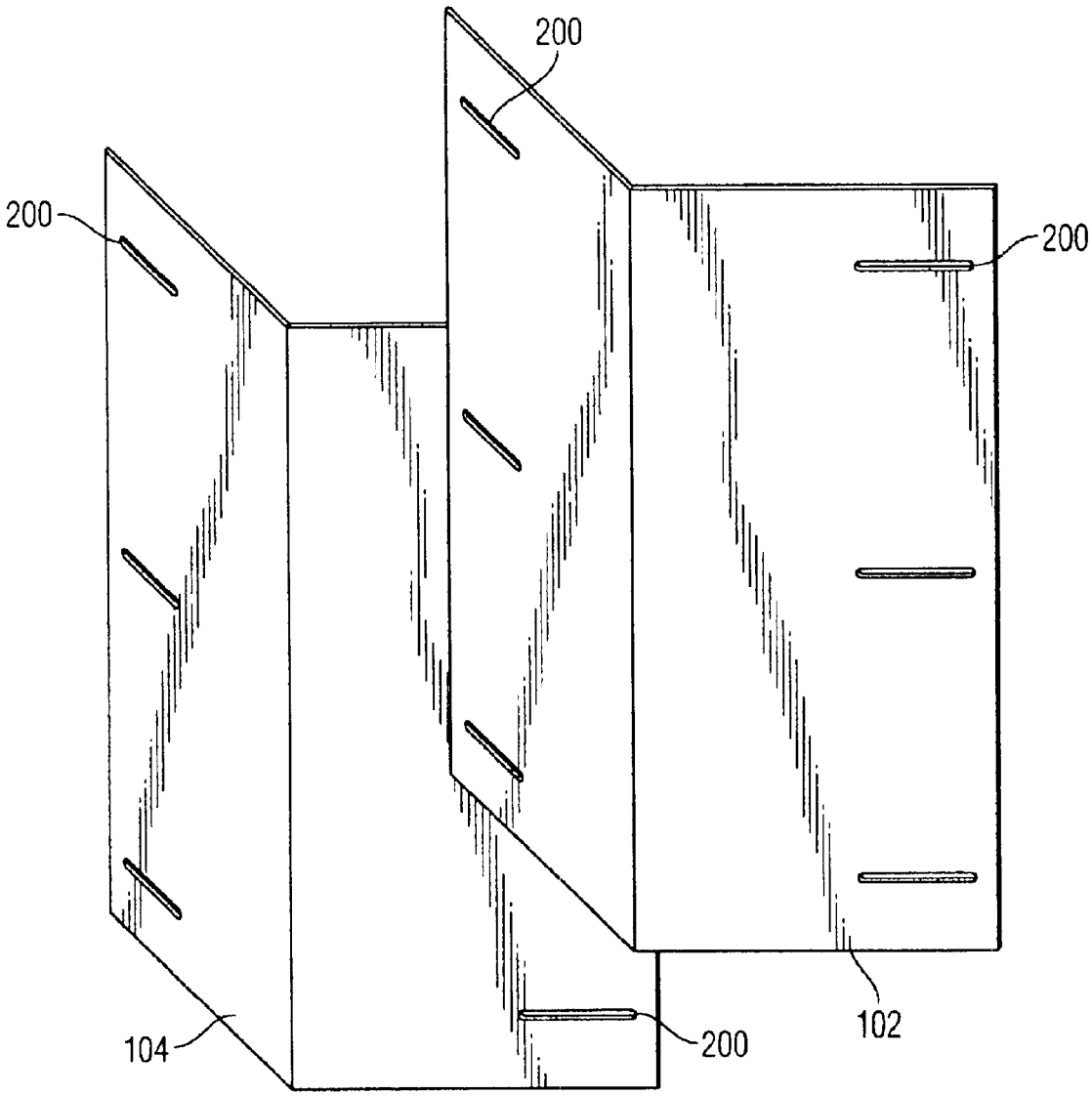
FIG. 22 is a perspective view of a pair of sheet metal members having horizontal slots therein.

As shown in FIG. 22 the sheet metal members 102 and 104 each may have a plurality of spaced-apart horizontal slots 200 formed therein.

Figure 23:
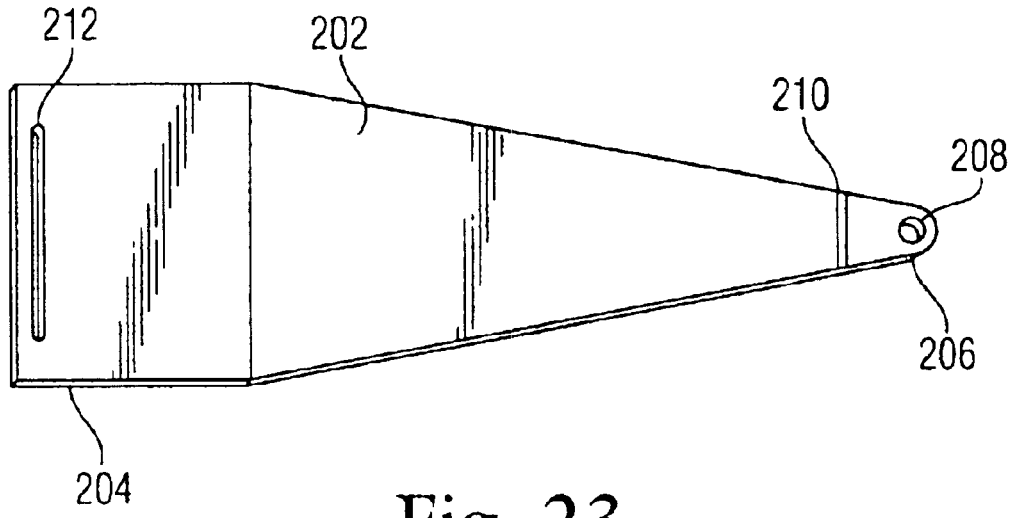
FIG. 23 is a perspective view of the receiver plate.
Figure 24:
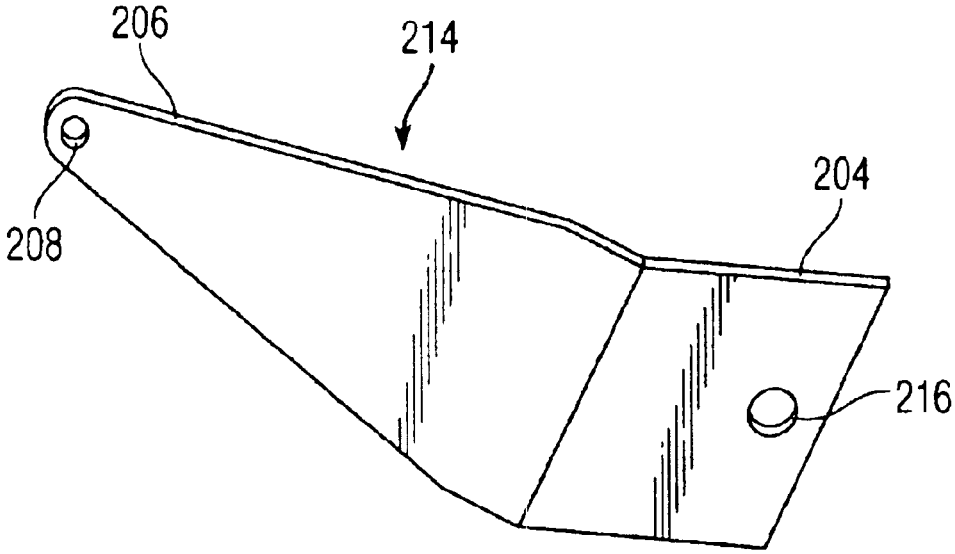
FIG. 24 is a perspective view of the right angle receiver.

A receiver plate 202 is, preferably, a flat steel piece having a wider first end 204 and a tapered, narrower opposite second end 206. A through opening 208 is formed in the narrower end 206 of the receiver plate 202. A stressed relief mark 210 is formed near the narrower end 206 and between the first end 204 and the second end 206. A slotted opening 212 is formed near the wider first end 204 of the receiver plate 202 as shown in FIG. 23.

A right angle receiver 214 may also be used as will be explained. The right angle receiver 214 is a flat plate having a right angle bend therein forming a wider first end 204 and a tapered narrower second end 206. A through opening 208 is formed in the second end 206. A hole 216 is formed near the first end 204 of the right angle receiver 214.

In a preferred embodiment, the inner sheet metal member 104 and the outer sheet metal member 102 are set up opposite to one another with form panels 106 juxtapositioned to the respective sheet metal members 102, 104. The distance d between the form panels 106 is predetermined and is the thickness of the concrete which is to be poured between the form panels 106.

The narrower second end 206 of the receiver plate 202 is inserted into a selected horizontal slot 200 in the outer sheet metal member 102 and pushed through the adjacent form panel 106 until the opening 208 in the narrower end extends through the form panel 106 into the space between the opposing form panels 106.

Figure 25:
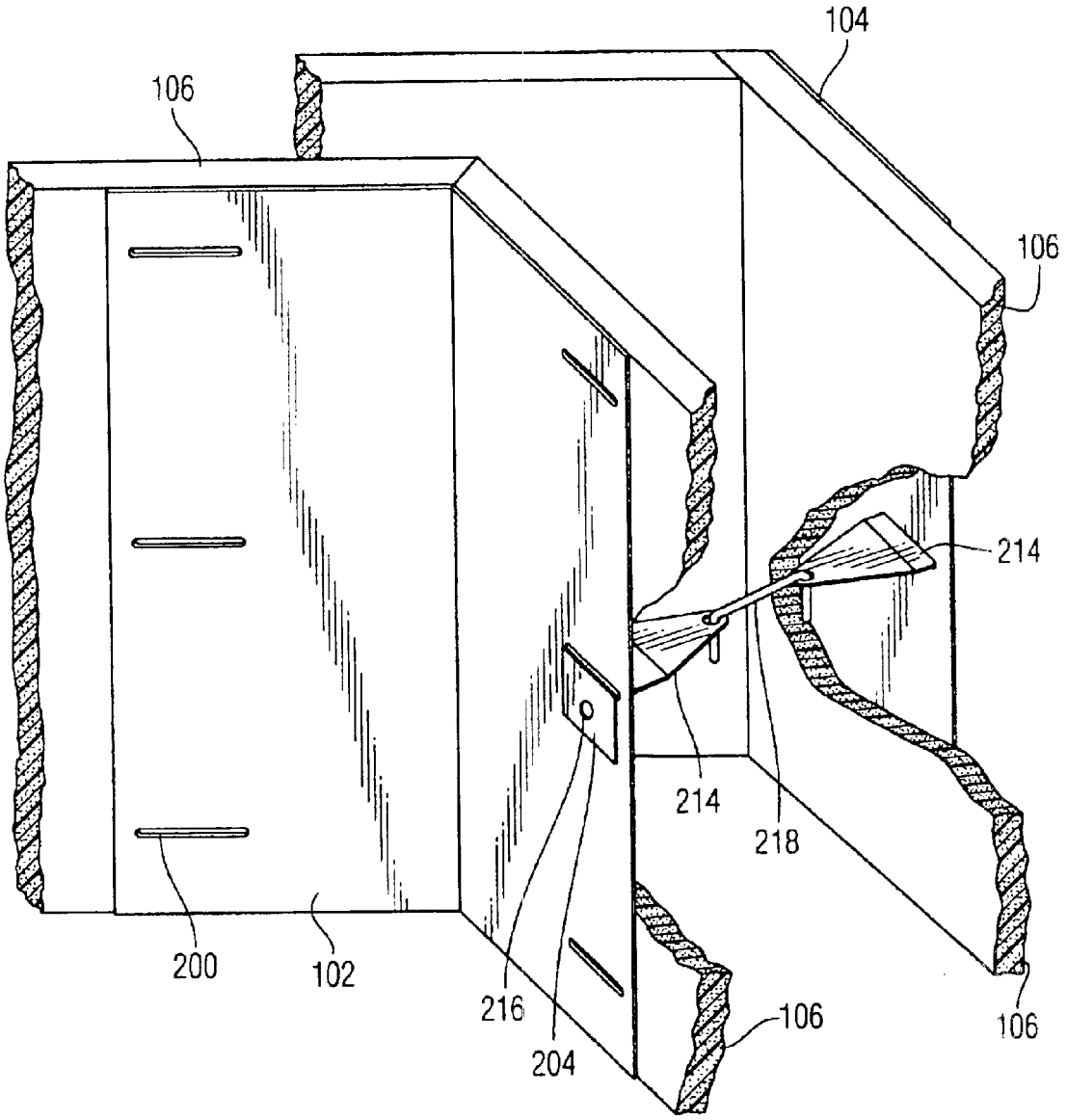
FIG. 25 is a partial cutaway perspective view of the corner assembly having a bridge member.

In a similar manner, a receiver plate 202 is inserted into a selected horizontal slot 200 in the inner sheet metal member 104 and through the adjacent form panel 106. The opening 208 extends through form panel into the space between the panels. As shown in FIG. 25, a bridge member 218 is formed having a bent first end and an opposite bent second end. Preferably, the bridge member 218 is formed from a metal wire but the bridge member may be formed from any rigid, sturdy material. It is simple and economical to form the bridge member from a spool of commercially available wire having a diameter of up to ⅜ inch. It is further preferred that the ends be bent at an angle of 90° or any angle specified. The respective ends of the bridge member 216 are received in the respective through openings 208 in the narrower ends 206 of the receiver plates 202 which extend from the outer sheet metal member 104 and the inner sheet metal 102 and through the form panels 106. The bridge member 218 secures the inner 102 and outer 104 sheet metal members to one another and provides reinforcement for the concrete 114, which is poured between the form panels 106. In addition, the length of the bridge member 218 is selected based on the thickness of the concrete which is to be formed.

Figure 26:
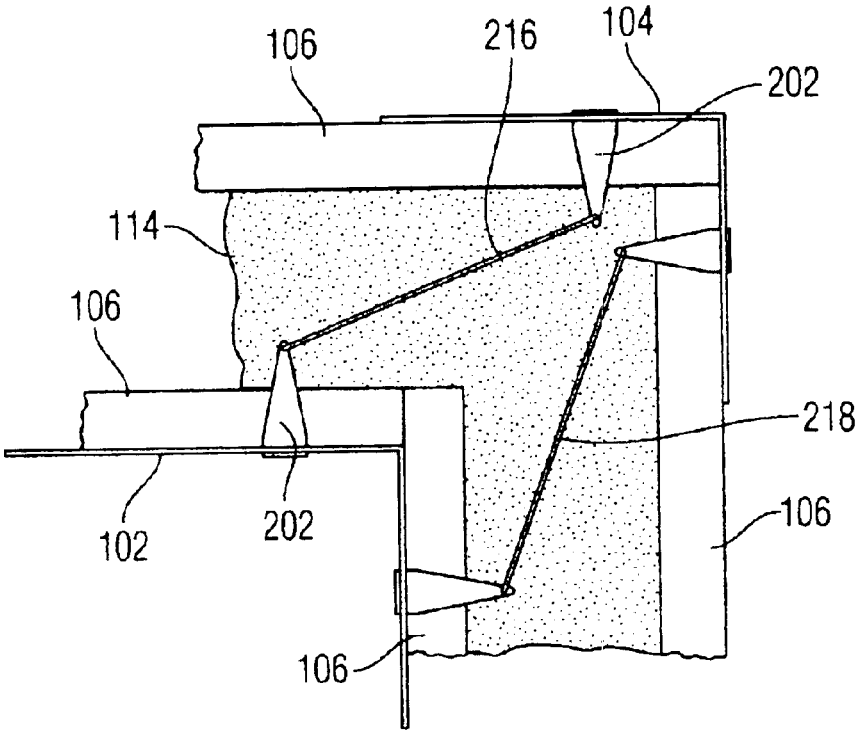
FIG. 26 is a top plan view of the corner assembly showing the bridges angularly connected to the receiver plates in the inner and outer sheet metal members.

It should be noted that the slots 200 in the inner 102 and outer 104 sheet metal members are aligned in the same horizontal plane so that the bridge member 218 may easily and effectively interconnect the receiver plates 202 or 214 which are disposed in the respective horizontal slots 200. However, the horizontal slots 200 in the inner 102 and outer 104 sheet metal members may not be in the same vertical plane. If desired, the horizontal slots 200 may be formed in the inner sheet metal member 102 proximal to the bend therein and the horizontal slots 200 may be formed in the outer sheet metal member 104 distal to bend therein so that when the corner is assembled, the horizontal slots 200 are in the same vertical plane. In this embodiment, the bridge member 218 is approximately perpendicular to the inner sheet metal member 102 and the outer sheet metal member 104 and to the form panels 106 adjacent to the sheet metal members 102, 106. However, if the inner sheet member 102 and the outer sheet metal 104 are identical in shape and size for economy of production and to avoid a large inventory of different parts, the horizontal slots 200 are offset in a vertical plane. In this situation, the bridge member 218 has a greater length and is disposed angularly between the inner sheet metal member 102 and the outer sheet metal member 104 as shown in FIG. 26.

Figure 27:
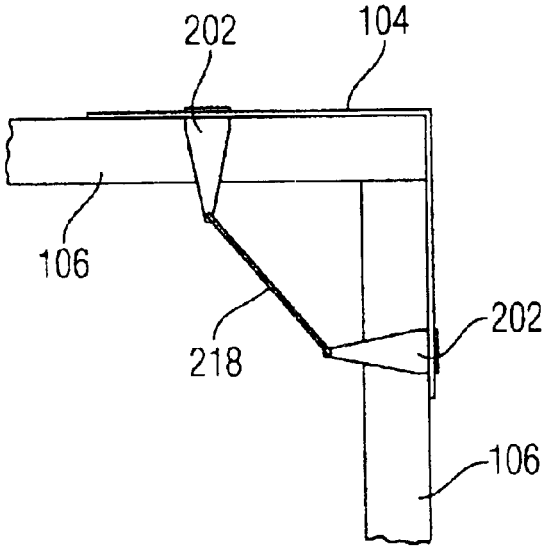
FIG. 27 is a top plan view of receiver plates in the outer sheet metal member connected by a bridge member.

As shown in FIG. 27, the receiver plates 202 may be inserted through the horizontal slots 200 in the same sheet metal member 104 and through the adjacent form panels 106. A bridge member 218 connects the two receiver plates 202. The bridge member 218 is disposed at an angle of approximately 45° with respect to the form panels 106. This structure provides additional strength to the corner assembly, especially when the concrete is poured and stress is applied to the corner.

Figure 28:
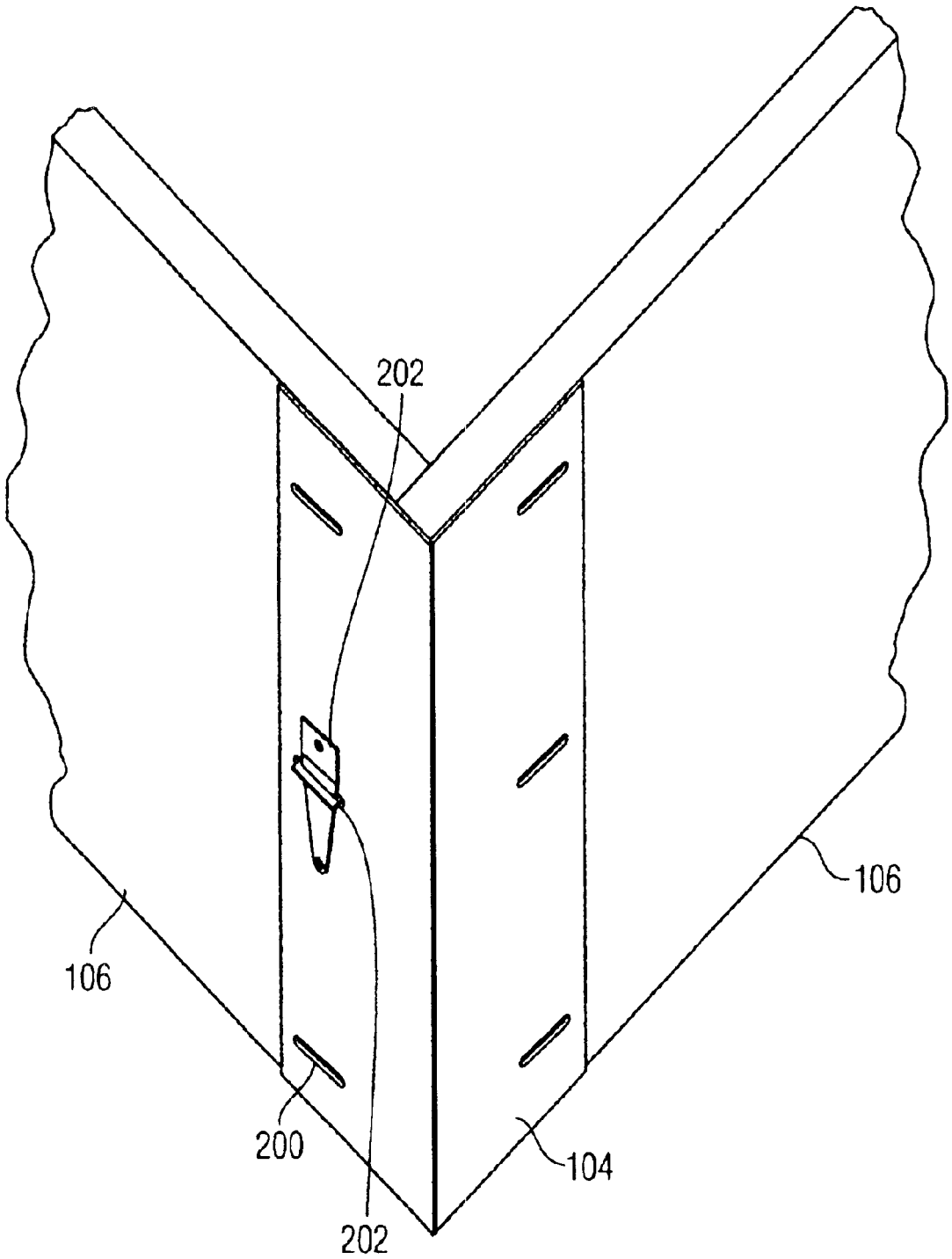
FIG. 28 is a perspective view of a wedge means serving as a stop for the receiver plate.

In order to assure that the receiver plate 202 is anchored in the horizontal slot 200 in the sheet metal member 102, 104, a stop means is provided. In one embodiment, the receiver plate 202 has a slotted opening 212 near the wider end 204. The slotted opening 212 remains exteriorly of the sheet metal member 102, 104 when the receiver plate 202 is inserted through the form panel 106. The wedge means may be any device having a tapered end which has a thickness to be received in the slotted opening 212 and a taper which lodges the wedge means in the slotted opening 212. Because of the availability of receiver plates 202 at the job site, a separate receiver plate 202 may be conveniently used as the wedge means (FIG. 28). The narrower end 206 of the separate receiver plate 202 is received in the slotted opening 212 and serves as a stop means. The separate receiver plate 202 is perpendicular to the receiver plate which passes through the sheet metal member 102 and through the form panel 106 and the separate receiver plate 212 is approximately parallel to the sheet metal member 102.

Figure 29:
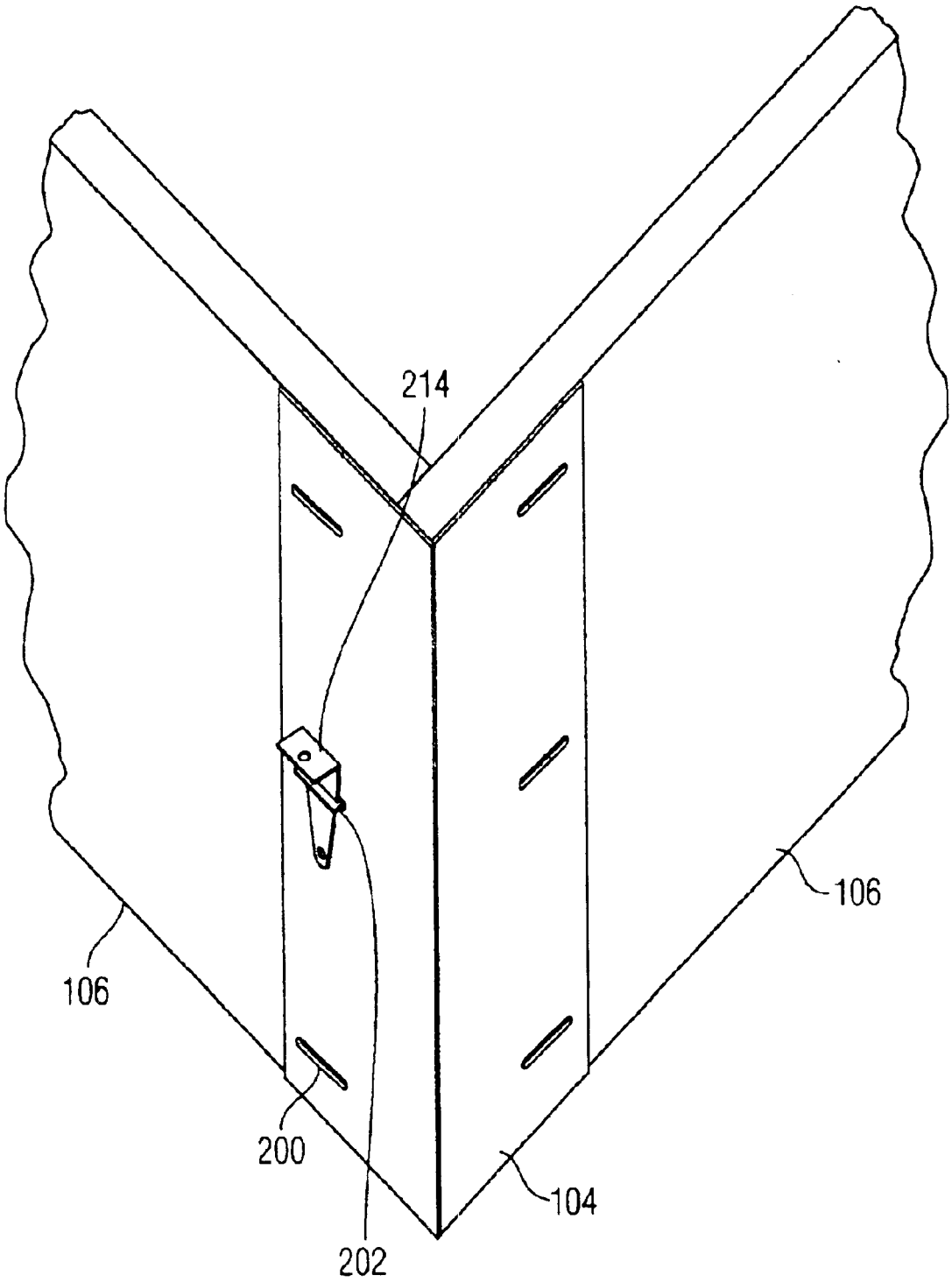
FIG. 29 is a perspective view of the right angle receiver serving as a stop for the receiver plate.

As shown in FIG. 29, the wedge means could also be the right angle receiver 214 in which the narrower end 206 is received in the slotted opening 212 in the receiver plate 202 which extends through the sheet metal ember 102 and the form panel 106. The angled first end 204 of the right angle receiver 214 is directed outwardly from the sheet metal member 102.

Figure 30:
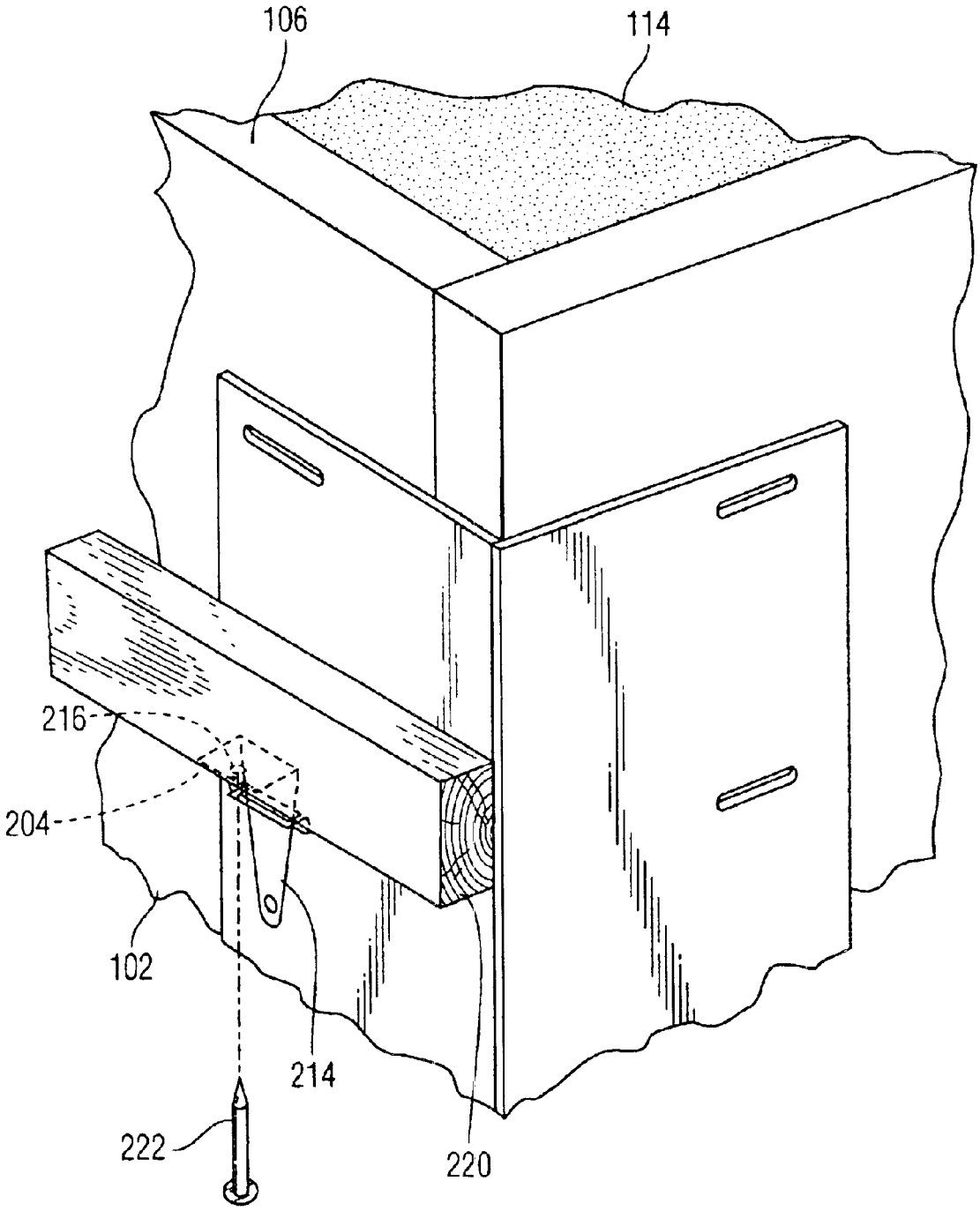
FIG. 30 is a perspective view of attaching internal material to the corner assembly.

The right angle receiver 214 acting as a stop means also may be used as a support for attaching external material to the corner assembly as shown in FIG. 30. As shown, a beam 220 is supported on the first end 204 of the right angle receiver 214. A screw or fastener 222 is inserted through the hole 216 in the first end 204 of the right angle receiver and into the beam 220. The external material may be used to straighten and/or strengthen the wall or corner assembly.

Figure 31:
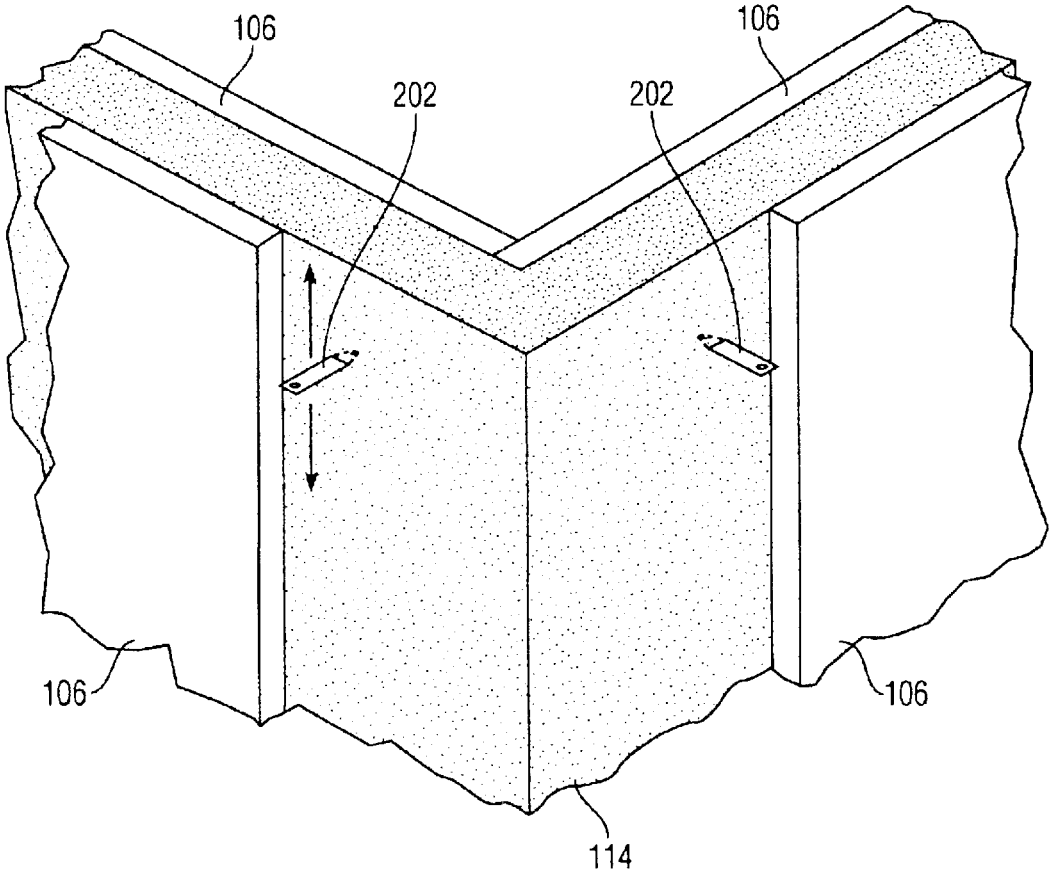
FIG. 31 is a perspective view of the concrete wall after some of the form panel and the sheet metal member have been removed.

After the concrete has been poured and the concrete has set, the sheet metal member 102, 104 and the form panels 106 may be removed so that the concrete wall remains. This is accomplished by removing the stop means from the receiver plate 202. If, as is preferred, more than one receiver plate 202 has been used with a single sheet metal member 102, 104, the stop means are removed from all of the receiver plates 202. Removal can be produced by applying upward pressure against the tapered end of the wedge or stop means until the wedge is pushed out of the slotted opening 212 in the receiver plate 202. The sheet metal member 102, 104 is then removed by pulling outwardly from the concrete. This will leave a portion of the receiver plate 202 protruding outwardly from the form panel 106. If desired, the structure could be left with the form panel exteriorly of the concrete wall. The form panels 106 are then removed by pulling outwardly from the concrete. This removal may be facilitated by having placed a lubricate or delaminate on the face of the form panel 106 before the concrete was poured along the lubricated face. After the form panel 106 is removed, the concrete wall has at least one receiver plate 202 extending outwardly from the wall as shown in FIG. 31. The portion of the extending receiver plate 202 is broken off by moving the portion upwardly and downwardly (see arrows) until the portion breaks along the stressed relief mark 210. Thus, an uninterrupted concrete wall can be formed. Depending upon the intended purpose, it is possible to remove the sheet metal members both internally and externally, only internally or only externally.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a form assembly used for concrete construction, wherein the concrete is poured between spaced-apart plastic form panels, the form panels being retained during the pouring of the concrete, the improvement comprising a metal corner assembly having two bent sheet metal members, an inner member and an outer member spaced apart a preselected distance, each bent metal sheet metal member having at least one horizontal slot formed therein, the plastic form panels being received within the respective first and second metal members and retained thereby during the pouring of the concrete into the space between the respective plastic form panels, at least one receiver plate, the at least one receiver plate having a length, a wider end and an opposite narrower end, the narrower end having an opening therethrough, the narrower end of the at least one receiver plate being received in the at least one horizontal slot on the sheet metal member such that the opening in the narrower end extends through the plastic panel within the sheet metal member such that the at least one receiver plate is approximately perpendicular to the bent sheet metal member, the at least one receiver plate having a stop means on the wider end, at least one bridge member having a length, a bent first end and a bent opposite second end, the bent first end of the at least one bridge being received in the opening in the at least one receiver plate in the outer bent sheet metal and the second bent end of the at least one bridge member being received in the opening in the at least one receiver plate in the inner bent sheet metal member, such that the inner and outer sheet metal members are secured and spaced apart by the preselected distance.

2. The form assembly of claim 1, further comprising the at least one receiver plate having a slot formed transversely in the wider end thereof, a wedge means being received in the transverse slot of the at least one receiver plate, the wedge means being approximately perpendicular to the transverse slot such that the wedge means serves as the stop means and is approximately parallel to the bent sheet metal member.

3. The form assembly of claim 2, wherein after the concrete has set, the wedge means may be removed from the slot in the at least one receiver plate, the outer bent sheet metal member may be removed and the plastic form panel may be removed, such that a portion of the at least one receiver plate extends outwardly from the concrete, the at least one receiver plate further having a stressed relief mark formed between the narrower end and the wider end, wherein the portion of the at least one receiver plate extending outwardly from the concrete may be broken off providing an uninterrupted surface of the concrete.

4. The form assembly of claim 1, wherein the wedge means is the narrower end of a separate receiver plate.

5. The form assembly of claim 1, wherein the at least one horizontal slot in the inner sheet metal member and the at least one horizontal slot in the outer sheet metal member are disposed in a horizontal plane and are offset from one another in a vertical plane such that the narrower end of the receiver plates extending through the plastic panels are horizontally aligned and vertically offset, wherein the at least one bridge member is disposed angularly between inner sheet metal member and the outer sheet metal member.

6. The form assembly of claim 1, wherein the length of the at least one receiver plate is determined by thickness of the plastic form panel.

7. The form assembly of claim 1, wherein the length of the bridge member is determined by the distance between the spaced apart form panels.

8. In a form assembly used for concrete construction, wherein the concrete is poured between spaced-apart plastic form panels, the form panels being retained during the pouring of the concrete, the improvement comprising a metal corner assembly having two bent sheet metal members, an inner member and an outer member spaced apart a preselected distance, each bent metal sheet metal member having a plurality of spaced-apart horizontal slots formed therein, the plastic form panels being received within the respective first and second metal members and retained thereby during the pouring of the concrete into the space between the respective plastic form panels, a plurality of right angle receivers, each right angle receiver being a plate having a tapered end and an opposite end, the plate having a right angle bend between the ends, a through hole being formed in the tapered end, the tapered end being received in a respective selected horizontal slot in the sheet metal member such that the opening in the narrower end extends through the plastic panel within the sheet metal member, a bridge member having a length, a bent first end and an opposite bent second end, the bent first end of the bridge being received in the opening in the right angle receiver in the outer sheet metal member and the bent second end of the bridge being received in the opening in the right angle receiver in the inner sheet metal member such that the inner and outer sheet metal members are secured and spaced apart by the preselected distance.

9. The form assembly of claim 8, wherein the opposite end of the right angle receiver extends externally of the outer sheet metal member, an external member being supported on said opposite end to provide additional support for the form assembly.

10. The form assembly of claim 8, further comprising a hole formed in the opposite end of the right angle receiver such that a fastening means may pass through the hole into the external member.

11. A corner assembly for concrete form panels comprising:

a rigid member having an inner face and a bend therein forming a selected dihedral angle having a first side and a second side, at least one horizontal slot formed in the first side and at least one horizontal slot formed in the second side, a pair of plastic panels disposed in juxtaposition to one another within the first side and the second side of the rigid member, at least one first receiver plate passing through the at least one horizontal slot in the first side and a portion thereof projecting beyond the plastic panel within the first side, at least one second receiver plate passing through the at least one horizontal slot in the second side and a portion thereof projecting beyond the plastic panel within the second side, said projecting portions of the at least one first receiver plate and the at least one second receiver plate, each having an opening formed therein, at least one bridge having a downwardly bent first end and a downwardly bent second end, the respective ends of the at least one bridge being received in the respective openings of the at least one first receiver plate and of the at least one second receiver plate, such that the plastic panels are secured within the inner face of the rigid member.

12. In a building structure, wherein concrete is to be poured into a form at a corner of the building structure, and wherein the form includes at least one pair of plastic panels disposed in juxtaposition to each other, the improvement comprising an external corner reinforcement including a pair of integrally-formed side members forming a dihedral angle therebetween, at least one of the side members of the external corner reinforcement being disposed adjacent to one of the plastic panels, said one side member having an opening formed therein, a first receiver plate passing through side member and through said one plastic panel and having a portion projecting therebeyond, said projecting portion of the receiver plate having an opening formed therein, stop means limiting the passage of the receiver plate through the said one plastic panel, the other plastic panel having a second receiver plate anchored therein, said second receiver plate having a portion projecting beyond said other plastic panel and having an opening formed therein, and a bridge having a pair of ends bent downwardly at an angle to the bridge, such that the ends of the bridges are received in the respective openings of the first and second receiver plates.

13. In a building structure, wherein concrete is to be poured into a form at a corner of the building structure, and wherein the form includes a pair of plastic panels disposed in abutting relationship transversely to each other, the improvement comprising an external corner reinforcement formed of bent sheet metal and including a pair of integrally-formed side members forming a dihedral angle therebetween, each side member of the external corner reinforcement being disposed adjacent to one of the plastic panels and externally thereof, each side member having at least one opening formed therein, a pair of retainers including one for each plastic panel, each retainer being inserted through a respective opening in a respective side member and through the respective plastic panel, external stop means limiting the passage of the retainer through the opening in the respective side member, such retainer having a portion thereof projecting beyond the respective plastic panel, the projecting portion of the retainer having an opening formed thereon, and a bridge having a pair of ends bent downwardly at an angle to the bridge, such that the ends of the bridge are received in the respective openings of the receivers, thereby anchoring the external corner reinforcement to the plastic panels.

14. The improvement of claim 13, wherein the bridge is disposed transversely of the external corner reinforcement.

15. The improvement of claim 14, wherein the plastic panels are disposed approximately at a right angle to each other, wherein the dihedral angle of the side members of the external corner reinforcement is approximately a right angle, and wherein the bridge is disposed at an angle of approximately 45° to the plastic panels.

16. The improvement of claim 13, wherein the bridge comprises a metal rod, and wherein the ends of the bridges are bent approximately at a right angle to the bridge.

17. A method of concrete construction comprising the steps of:

providing a plurality of form panels, providing a pair of rigid members, an inner member and an outer member, each rigid member having a bend therein forming a selected dihedral angle, each rigid member having at least one slot formed horizontally therein, providing a plurality of form panels, disposing two pair of the form panels at the selected dihedral angle, one pair being juxtapositioned to the inner member and the other pair being juxtapositioned to the outer member wherein the pairs of form panels are opposite from one another, providing at least two receiver plates, each receiver plate having a length, a wider end and an opposite narrower end, the narrower end of each receiver plate have an opening therethrough, inserting at least one receiver plate in the at least one horizontal slot in the outer rigid member and through the form panel such that a portion of the narrower end of the receiver plate with the opening therein projects beyond the form panel, repeating the step of inserting at least one receiver plate in the inner rigid member and the form panel as above, providing a bridge having downwardly turned ends, inserting the respective ends of the bridge into the respective openings in the projecting portions of the receiver plates, pouring concrete between the opposing pairs of form panels and over the bridge therebetween, allowing the concrete to set up.

18. The method of claim 17, further comprising:

providing a stress relief mark on each receiver plate, said mark being closer to the narrower end than to the wider end of the receiver plate, removing the outer rigid member from the concrete construction, removing the form panel from the concrete construction whereby the wider end of the receiver plate extends outwardly from the concrete, breaking the receiver plate at the stress relief mark such that an uninterrupted surface of concrete is provided.

* * * * *